US010632363B2

(12) United States Patent
Krenn et al.

(10) Patent No.: US 10,632,363 B2
(45) **Date of Patent: *Apr. 28, 2020**

(54) CARD HANDLING DEVICES AND RELATED ASSEMBLIES AND COMPONENTS

(71) Applicant: Shuffle Master GmbH & Co KG, Vienna (AT)

(72) Inventors: Peter Krenn, Neufeld (AT); Ernst Blaha, Tullnerbach (AT)

(73) Assignee: Shuffle Master GmbH & Co KG, Vienna (AT)

( * ) Notice: Subject to any disclaimer, the term of this patent is extended or adjusted under 35 U.S.C. 154(b) by 0 days.

This patent is subject to a terminal disclaimer.

(21) Appl. No.: 15/968,473

(22) Filed: May 1, 2018

(65) Prior Publication Data

US 2018/0243642 A1 Aug. 30, 2018

Related U.S. Application Data

(62) Division of application No. 14/959,536, filed on Dec. 4, 2015, now Pat. No. 9,993,719.

(51) Int. Cl.
*A63F 1/14* (2006.01)
*A63F 1/12* (2006.01)
(Continued)

(52) U.S. Cl.
CPC ..... *A63F 1/12* (2013.01); *A63F 1/14* (2013.01); *G07F 11/045* (2013.01); *G07F 11/14* (2013.01)

(58) Field of Classification Search
CPC ..... A63F 1/12; A63F 1/10; A63F 1/14; A63F 2250/58
(Continued)

(56) References Cited

U.S. PATENT DOCUMENTS 130,281 A 8/1872 Coughlin
205,030 A 6/1878 Ash
(Continued)

FOREIGN PATENT DOCUMENTS

AU 2383667 A 1/1969
AU 5025479 A1 3/1980
(Continued)

OTHER PUBLICATIONS

Shuffle Master, Inc. (1996). Let It Ride, The Tournament, User Guide, 72 pages.

(Continued)

*Primary Examiner* — Benjamin Layno
(74) *Attorney, Agent, or Firm* — TraskBritt

(57) ABSTRACT

Card handling devices may include a card shuffling apparatus and a card output portion having a card buffer area positioned at an interface of the card shuffling apparatus and the card output portion. The card output portion may be configured to move relative to the card shuffling apparatus and alter the orientation of the card buffer area. Card handling devices having a substantially flat card output area may include an interface portion having an at least substantially flat draw surface. The substantially flat card output area may permit playing cards to be drawn from an outlet of the substantially flat card output area in a plurality of at least substantially horizontal directions. Methods of shuffling playing cards may include altering an orientation of a card buffer area and inserting cards into the card buffer area at both a top and a bottom of a group of cards within the card buffer area.

20 Claims, 15 Drawing Sheets

(51) Int. Cl.
*G07F 11/14* (2006.01)
*G07F 11/04* (2006.01)

(58) Field of Classification Search
USPC ..... 273/149 R, 149 P; 463/22
See application file for complete search history.

(56) References Cited

U.S. PATENT DOCUMENTS 609,730 A 8/1898 Booth
673,154 A 4/1901 Bellows
793,489 A 6/1905 Williams
892,389 A 7/1908 Bellows
1,014,219 A 1/1912 Hall
1,043,109 A 11/1912 Hurm
1,157,898 A 10/1915 Perret
1,256,509 A 2/1918 Belknap
1,380,898 A 6/1921 Hall
1,556,856 A 10/1925 Lipps
1,757,553 A 5/1930 Tauschek
1,850,114 A 3/1932 McCaddin
1,885,276 A 11/1932 McKay
1,889,729 A 11/1932 Hammond
1,955,926 A 4/1934 Matthaey
1,992,085 A 2/1935 McKay
1,998,690 A 4/1935 Shepherd et al.
2,001,220 A 5/1935 Smith
2,001,918 A 5/1935 Nevius
2,016,030 A 10/1935 Woodruff et al.
2,043,343 A 6/1936 Warner
2,060,096 A 11/1936 McCoy
2,065,824 A 12/1936 Plass
2,159,958 A 5/1939 Sachs
2,185,474 A 1/1940 Nott
2,254,484 A 9/1941 Hutchins
D132,360 S 5/1942 Gardner
2,328,153 A 8/1943 Laing
2,328,879 A 9/1943 Isaacson
D139,530 S 11/1944 Schindler
2,364,413 A 12/1944 Wittel
2,525,305 A 10/1950 Lombard
2,543,522 A 2/1951 Cohen
2,588,582 A 3/1952 Sivertson
2,615,719 A 10/1952 Fonken
2,659,607 A 11/1953 Skillman et al.
2,661,215 A 12/1953 Stevens
2,676,020 A 4/1954 Ogden
2,692,777 A 10/1954 Miller
2,701,720 A 2/1955 Ogden
2,705,638 A 4/1955 Newcomb
2,711,319 A 6/1955 Morgan et al.
2,714,510 A 8/1955 Oppenlander et al.
2,717,782 A 9/1955 Droll
2,727,747 A 12/1955 Semisch, Jr.
2,731,271 A 1/1956 Brown
2,747,877 A 5/1956 Howard
2,755,090 A 7/1956 Aldrich
2,757,005 A 7/1956 Nothaft
2,760,779 A 8/1956 Ogden et al.
2,770,459 A 11/1956 Wilson et al.
2,778,643 A 1/1957 Williams
2,778,644 A 1/1957 Stephenson
2,782,040 A 2/1957 Matter
2,790,641 A 4/1957 Adams
2,793,863 A 5/1957 Liebelt
2,815,214 A 12/1957 Hall
2,821,399 A 1/1958 Heinoo
2,914,215 A 11/1959 Neidig
2,937,739 A 5/1960 Levy
2,950,005 A 8/1960 MacDonald
RE24,986 E 5/1961 Stephenson
3,067,885 A 12/1962 Kohler
3,107,096 A 10/1963 Osborn
3,124,674 A 3/1964 Edwards et al.
3,131,935 A 5/1964 Gronneberg
3,147,978 A 9/1964 Sjostrand
D200,652 S 3/1965 Fisk
3,185,482 A 5/1965 Russell
3,222,071 A 12/1965 Lang
3,235,741 A 2/1966 Plaisance
3,288,308 A 11/1966 Gingher
3,305,237 A 2/1967 Granius
3,312,473 A 4/1967 Friedman et al.
3,452,509 A 7/1969 Hauer
3,530,968 A 9/1970 Palmer
3,588,116 A 6/1971 Miura
3,589,730 A 6/1971 Slay
3,595,388 A 7/1971 Castaldi
3,597,076 A 8/1971 Hubbard et al.
3,598,396 A 8/1971 Andrews et al.
3,618,933 A 11/1971 Roggenstein et al.
3,627,331 A 12/1971 Lyon, Jr.
3,666,270 A 5/1972 Mazur
3,680,853 A 8/1972 Houghton et al.
3,690,670 A 9/1972 Cassady et al.
3,704,938 A 12/1972 Fanselow
3,716,238 A 2/1973 Porter
3,751,041 A 8/1973 Seifert
3,761,079 A 9/1973 Azure, Jr.
3,810,627 A 5/1974 Levy
D232,953 S 9/1974 Oguchi
3,861,261 A 1/1975 Maxey
3,897,954 A 8/1975 Erickson et al.
3,899,178 A 8/1975 Watanabe
3,909,002 A 9/1975 Levy
3,929,339 A 12/1975 Mattioli
3,944,077 A 3/1976 Green
3,944,230 A 3/1976 Fineman
3,949,219 A 4/1976 Crouse
3,968,364 A 7/1976 Miller
4,023,705 A 5/1977 Reiner et al.
4,033,590 A 7/1977 Pic
4,072,930 A 2/1978 Lucero et al.
4,088,265 A 5/1978 Garczynski
4,151,410 A 4/1979 McMillan et al.
4,159,581 A 7/1979 Lichtenberg
4,162,649 A 7/1979 Thornton
4,166,615 A 9/1979 Noguchi et al.
4,232,861 A 11/1980 Maul
4,280,690 A 7/1981 Hill
4,283,709 A 8/1981 Lucero et al.
4,310,160 A 1/1982 Willette et al.
4,339,134 A 7/1982 Macheel
4,339,798 A 7/1982 Hedges et al.
4,361,393 A 11/1982 Noto
4,368,972 A 1/1983 Naramore
4,369,972 A 1/1983 Parker
4,374,309 A 2/1983 Walton
4,377,285 A 3/1983 Kadlic
4,385,827 A 5/1983 Naramore
4,388,994 A 6/1983 Suda et al.
4,397,469 A 8/1983 Carter, III
4,421,312 A 12/1983 Delgado et al.
4,421,501 A 12/1983 Scheffer
D273,962 S 5/1984 Fromm
D274,069 S 5/1984 Fromm
4,457,512 A 7/1984 Stevenson
4,467,424 A 8/1984 Hedges et al.
4,494,197 A 1/1985 Troy et al.
4,497,488 A 2/1985 Plevyak et al.
4,512,580 A 4/1985 Matviak
4,513,969 A 4/1985 Samsel, Jr.
4,515,367 A 5/1985 Howard
4,531,187 A 7/1985 Uhland
4,534,562 A 8/1985 Cuff et al.
4,549,738 A 10/1985 Greitzer
4,566,782 A 1/1986 Britt et al.
4,575,367 A 3/1986 Karmel
4,586,712 A 5/1986 Lorber et al.
4,659,082 A 4/1987 Greenberg
4,662,637 A 5/1987 Pfeiffer
4,662,816 A 5/1987 Fabrig
4,667,959 A 5/1987 Pfeiffer et al.
4,741,524 A 5/1988 Bromage
4,750,743 A 6/1988 Nicoletti

(56) References Cited

U.S. PATENT DOCUMENTS 4,755,941 A 7/1988 Bacchi
4,759,448 A 7/1988 Kawabata
4,770,412 A 9/1988 Wolfe
4,770,421 A 9/1988 Hoffman
4,807,884 A 2/1989 Breeding
4,822,050 A 4/1989 Normand et al.
4,832,342 A 5/1989 Plevyak et al.
4,858,000 A 8/1989 Lu
4,861,041 A 8/1989 Jones et al.
4,876,000 A 10/1989 Mikhail
4,900,009 A 2/1990 Kitahara et al.
4,904,830 A 2/1990 Rizzuto
4,921,109 A 5/1990 Hasuo et al.
4,926,327 A 5/1990 Sidley
4,948,134 A 8/1990 Suttle et al.
4,951,950 A 8/1990 Normand et al.
4,969,648 A * 11/1990 Hollinger ..... A63F 1/12 273/149 R
4,993,587 A 2/1991 Abe
4,995,615 A 2/1991 Cheng
5,000,453 A 3/1991 Stevens et al.
5,004,218 A 4/1991 Sardano et al.
5,039,102 A 8/1991 Miller
5,067,713 A 11/1991 Soules et al.
5,078,405 A 1/1992 Jones et al.
5,081,487 A 1/1992 Hoyer et al.
5,096,197 A 3/1992 Embury
5,102,293 A 4/1992 Schneider
5,118,114 A 6/1992 Tucci
5,121,192 A 6/1992 Kazui
5,121,921 A 6/1992 Friedman et al.
5,146,346 A 9/1992 Knoll
5,154,429 A 10/1992 LeVasseur
5,179,517 A 1/1993 Sarbin et al.
5,197,094 A 3/1993 Tillery et al.
5,199,710 A 4/1993 Lamle
5,209,476 A 5/1993 Eiba
5,224,712 A 7/1993 Laughlin et al.
5,240,140 A 8/1993 Huen
5,248,142 A 9/1993 Breeding
5,257,179 A 10/1993 DeMar
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding
5,299,089 A 3/1994 Lwee
5,303,921 A 4/1994 Breeding
5,344,146 A 9/1994 Lee
5,356,145 A 10/1994 Verschoor
5,362,053 A 11/1994 Miller
5,374,061 A 12/1994 Albrecht
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias
5,416,308 A 5/1995 Hood et al.
5,431,399 A 7/1995 Kelley
5,431,407 A 7/1995 Hofberg et al.
5,437,462 A 8/1995 Breeding
5,445,377 A 8/1995 Steinbach
5,470,079 A 11/1995 LeStrange et al.
D365,853 S 1/1996 Zadro
5,489,101 A 2/1996 Moody
5,515,477 A 5/1996 Sutherland
5,524,888 A 6/1996 Heidel
5,531,448 A 7/1996 Moody
5,544,892 A 8/1996 Breeding
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea, Jr.
5,613,912 A 3/1997 Slater
5,632,483 A 5/1997 Garczynski et al.
5,636,843 A 6/1997 Roberts
5,651,548 A 7/1997 French et al.
5,655,961 A 8/1997 Acres et al.
5,655,966 A 8/1997 Werdin et al.
5,669,816 A 9/1997 Garczynski et al.
5,676,231 A 10/1997 Legras et al.
5,676,372 A 10/1997 Sines et al.
5,681,039 A 10/1997 Miller
5,683,085 A 11/1997 Johnson et al.
5,685,543 A * 11/1997 Garner ..... A63F 1/14 273/148 A
5,690,324 A 11/1997 Otomo et al.
5,692,748 A 12/1997 Frisco et al.
5,695,189 A 12/1997 Breeding et al.
5,701,565 A 12/1997 Morgan
5,707,286 A 1/1998 Carlson
5,707,287 A 1/1998 McCrea, Jr.
5,711,525 A 1/1998 Breeding
5,718,427 A 2/1998 Cranford et al.
5,719,288 A 2/1998 Sens et al.
5,720,484 A 2/1998 Hsu
5,722,893 A 3/1998 Hill et al.
5,735,525 A 4/1998 McCrea, Jr.
5,735,724 A 4/1998 Udagawa
5,735,742 A 4/1998 French
5,743,798 A 4/1998 Adams et al.
5,768,382 A 6/1998 Schneier et al.
5,770,533 A 6/1998 Franchi
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 van Putten et al.
5,788,574 A 8/1998 Ornstein et al.
5,791,988 A 8/1998 Nomi
5,802,560 A 9/1998 Joseph et al.
5,803,808 A 9/1998 Strisower
5,810,355 A 9/1998 Trilli
5,813,326 A 9/1998 Salomon
5,813,912 A 9/1998 Shultz
5,814,796 A 9/1998 Benson
5,836,775 A 11/1998 Hiyama et al.
5,839,730 A 11/1998 Pike
5,845,906 A 12/1998 Wirth
5,851,011 A 12/1998 Lott
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea, Jr.
5,919,090 A 7/1999 Mothwurf
D412,723 S 8/1999 Hachuel et al.
5,936,222 A 8/1999 Korsunsky
5,941,769 A 8/1999 Order
5,944,310 A 8/1999 Johnson et al.
D414,527 S 9/1999 Tedham
5,957,776 A 9/1999 Hoehne
5,974,150 A 10/1999 Kaish et al.
5,989,122 A 11/1999 Roblejo
5,991,308 A 11/1999 Fuhrmann et al.
6,015,311 A 1/2000 Benjamin et al.
6,019,368 A 2/2000 Sines et al.
6,019,374 A 2/2000 Breeding
6,039,650 A 3/2000 Hill
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea, Jr.
6,113,101 A 9/2000 Wirth
6,117,012 A 9/2000 McCrea, Jr.

(56) References Cited

U.S. PATENT DOCUMENTS

D432,588 S 10/2000 Tedham
6,126,166 A 10/2000 Lorson et al.
6,131,817 A 10/2000 Miller
6,139,014 A 10/2000 Breeding et al.
6,149,154 A 11/2000 Grauzer et al.
6,154,131 A 11/2000 Jones, II et al.
6,165,069 A 12/2000 Sines et al.
6,165,072 A 12/2000 Davis et al.
6,183,362 B1 2/2001 Boushy
6,186,895 B1 2/2001 Oliver
6,196,416 B1 3/2001 Seagle
6,200,218 B1 3/2001 Lindsay
6,210,274 B1 4/2001 Carlson
6,213,310 B1 4/2001 Wennersten et al.
6,217,447 B1 4/2001 Lofink et al.
6,234,900 B1 5/2001 Cumbers
6,236,223 B1 5/2001 Brady et al.
6,250,632 B1 6/2001 Albrecht
6,254,002 B1 7/2001 Litman
6,254,096 B1 7/2001 Grauzer et al.
6,254,484 B1 7/2001 McCrea, Jr.
6,257,981 B1 7/2001 Acres et al.
6,267,248 B1 7/2001 Johnson et al.
6,267,648 B1 7/2001 Katayama et al.
6,267,671 B1 7/2001 Hogan
6,270,404 B2 8/2001 Sines et al.
6,272,223 B1 8/2001 Carlson
6,293,546 B1 9/2001 Hessing et al.
6,293,864 B1 9/2001 Romero
6,299,167 B1 10/2001 Sines et al.
6,299,534 B1 10/2001 Breeding et al.
6,299,536 B1 10/2001 Hill
6,308,886 B1 10/2001 Benson et al.
6,313,871 B1 11/2001 Schubert
6,325,373 B1 12/2001 Breeding et al.
6,334,614 B1 1/2002 Breeding
6,341,778 B1 1/2002 Lee
6,342,830 B1 1/2002 Want et al.
6,346,044 B1 2/2002 McCrea, Jr.
6,361,044 B1 3/2002 Block
6,386,973 B1 5/2002 Yoseloff
6,402,142 B1 6/2002 Warren et al.
6,403,908 B2 6/2002 Stardust et al.
6,443,839 B2 9/2002 Stockdale et al.
6,446,864 B1 9/2002 Kim et al.
6,454,266 B1 9/2002 Breeding et al.
6,460,848 B1 10/2002 Soltys et al.
6,464,584 B2 10/2002 Oliver
6,490,277 B1 12/2002 Tzotzkov
6,508,709 B1 1/2003 Karmarkar
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,561,897 B1 5/2003 Bourbour et al.
6,568,678 B2 5/2003 Breeding et al.
6,579,180 B2 6/2003 Soltys et al.
6,579,181 B2 6/2003 Soltys et al.
6,581,747 B1 6/2003 Charlier et al.
6,582,301 B2 6/2003 Hill
6,582,302 B2 6/2003 Romero
6,585,586 B1 7/2003 Romero
6,585,588 B2 7/2003 Hard
6,585,856 B2 7/2003 Zwick et al.
6,588,750 B1 7/2003 Grauzer et al.
6,588,751 B1 7/2003 Grauzer et al.
6,595,857 B2 7/2003 Soltys et al.
6,609,710 B1 8/2003 Order
6,612,928 B1 9/2003 Bradford et al.
6,616,535 B1 9/2003 Nishizaki et al.
6,619,662 B2 9/2003 Miller
6,622,185 B1 9/2003 Johnson et al.
6,626,757 B2 9/2003 Oliveras
6,629,019 B2 9/2003 Legge et al.
6,629,591 B1 10/2003 Griswold et al.
6,629,889 B2 10/2003 Mothwurf
6,629,894 B1 10/2003 Purton
6,637,622 B1 10/2003 Robinson
6,638,161 B2 10/2003 Soltys et al.
6,645,068 B1 11/2003 Kelly et al.
6,645,077 B2 11/2003 Rowe
6,651,981 B2 * 11/2003 Grauzer ..... A63F 1/12 273/149 P
6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,655,690 B1 12/2003 Oskwarek
6,658,135 B1 12/2003 Morito et al.
6,659,460 B2 12/2003 Blaha et al.
6,659,461 B2 12/2003 Yoseloff
6,659,875 B2 12/2003 Purton
6,663,490 B2 12/2003 Soltys et al.
6,666,768 B1 12/2003 Akers
6,671,358 B1 12/2003 Seidman et al.
6,676,127 B2 1/2004 Johnson et al.
6,676,517 B2 1/2004 Beavers
6,680,843 B2 1/2004 Farrow et al.
6,685,564 B2 2/2004 Oliver
6,685,567 B2 2/2004 Cockerille et al.
6,685,568 B2 2/2004 Soltys et al.
6,688,597 B2 2/2004 Jones
6,688,979 B2 2/2004 Soltys et al.
6,690,673 B1 2/2004 Jarvis
6,698,756 B1 3/2004 Baker et al.
6,698,759 B2 3/2004 Webb et al.
6,702,289 B1 3/2004 Feola
6,702,290 B2 3/2004 Buono-Correa et al.
6,709,333 B1 3/2004 Bradford et al.
6,712,696 B2 3/2004 Soltys et al.
6,719,288 B2 4/2004 Hessing et al.
6,719,634 B2 4/2004 Mishina et al.
6,722,974 B2 4/2004 Sines et al.
6,726,205 B1 4/2004 Purton
6,732,067 B1 5/2004 Powderly
6,733,012 B2 5/2004 Bui et al.
6,733,388 B2 5/2004 Mothwurf
6,746,333 B1 6/2004 Onda et al.
6,747,560 B2 6/2004 Stevens, III
6,749,510 B2 6/2004 Giobbi
6,758,751 B2 7/2004 Soltys et al.
6,758,757 B2 7/2004 Luciano, Jr. et al.
6,769,693 B2 8/2004 Huard et al.
6,774,782 B2 8/2004 Runyon et al.
6,789,801 B2 9/2004 Snow
6,802,510 B1 10/2004 Haber
6,804,763 B1 10/2004 Stockdale et al.
6,808,173 B2 10/2004 Snow
6,827,282 B2 12/2004 Silverbrook
6,834,251 B1 12/2004 Fletcher
6,840,517 B2 1/2005 Snow et al.
6,842,263 B1 1/2005 Saeki
6,843,725 B2 1/2005 Nelson
6,848,616 B2 2/2005 Tsirline et al.
6,848,844 B2 2/2005 McCue, Jr. et al.
6,848,994 B1 2/2005 Knust et al.
6,857,961 B2 2/2005 Soltys et al.
6,874,784 B1 4/2005 Promutico et al.
6,874,786 B2 4/2005 Bruno
6,877,657 B2 4/2005 Ranard et al.
6,877,748 B1 4/2005 Patroni et al.
6,886,829 B2 5/2005 Hessing et al.
6,889,979 B2 5/2005 Blaha et al.
6,893,347 B1 5/2005 Zilliacus et al.
6,899,628 B2 5/2005 Leen et al.
6,902,167 B2 6/2005 Webb
6,905,121 B1 6/2005 Timpano
6,923,446 B2 8/2005 Snow

(56) References Cited

U.S. PATENT DOCUMENTS

| | | | |
|---|---|---|---|
| 6,938,900 | B2 | 9/2005 | Snow |
| 6,941,180 | B1 | 9/2005 | Fisher et al. |
| 6,950,948 | B2 | 9/2005 | Neff |
| 6,955,599 | B2 | 10/2005 | Bourbour et al. |
| 6,957,746 | B2 | 10/2005 | Martin et al. |
| 6,959,925 | B1 | 11/2005 | Baker et al. |
| 6,960,134 | B2 | 11/2005 | Hartl et al. |
| 6,964,612 | B2 | 11/2005 | Soltys et al. |
| 6,986,514 | B2 | 1/2006 | Snow |
| 6,988,516 | B2 | 1/2006 | Debaes |
| 7,011,309 | B2 | 3/2006 | Soltys et al. |
| 7,020,307 | B2 | 3/2006 | Hinton et al. |
| 7,028,598 | B2 | 4/2006 | Teshima |
| 7,029,009 | B2 | 4/2006 | Grauzer et al. |
| 7,036,818 | B2 | 5/2006 | Grauzer et al. |
| 7,046,458 | B2 | 5/2006 | Nakayama |
| 7,046,764 | B1 | 5/2006 | Kump |
| 7,048,629 | B2 | 5/2006 | Sines et al. |
| 7,059,602 | B2 | 6/2006 | Grauzer et al. |
| 7,066,464 | B2 | 6/2006 | Blad et al. |
| 7,068,822 | B2 | 6/2006 | Scott |
| 7,073,791 | B2 | 7/2006 | Grauzer et al. |
| 7,079,010 | B2 | 7/2006 | Champlin |
| 7,084,769 | B2 | 8/2006 | Bauer et al. |
| 7,089,420 | B1 | 8/2006 | Durst et al. |
| D527,900 | S | 9/2006 | Dewa |
| 7,106,201 | B2 | 9/2006 | Tuttle |
| 7,113,094 | B2 | 9/2006 | Garber et al. |
| 7,114,718 | B2 | 10/2006 | Grauzer et al. |
| 7,124,947 | B2 | 10/2006 | Storch |
| 7,128,652 | B1 | 10/2006 | Lavoie et al. |
| 7,137,627 | B2 | 11/2006 | Grauzer et al. |
| 7,139,108 | B2 | 11/2006 | Andersen et al. |
| 7,140,614 | B2 | 11/2006 | Snow |
| 7,162,035 | B1 | 1/2007 | Durst et al. |
| 7,165,769 | B2 | 1/2007 | Crenshaw et al. |
| 7,165,770 | B2 | 1/2007 | Snow |
| 7,175,522 | B2 | 2/2007 | Hartl |
| 7,186,181 | B2 | 3/2007 | Rowe |
| 7,201,656 | B2 | 4/2007 | Darder |
| 7,202,888 | B2 | 4/2007 | Tecu et al. |
| 7,203,841 | B2 | 4/2007 | Jackson et al. |
| 7,213,812 | B2 | 5/2007 | Schubert |
| 7,222,852 | B2 | 5/2007 | Soltys |
| 7,222,855 | B2 | 5/2007 | Sorge |
| 7,231,812 | B1 | 6/2007 | Lagare |
| 7,234,698 | B2 | 6/2007 | Grauzer et al. |
| 7,237,969 | B2 | 7/2007 | Bartman |
| 7,243,148 | B2 | 7/2007 | Keir et al. |
| 7,243,698 | B2 | 7/2007 | Siegel |
| 7,246,799 | B2 | 7/2007 | Snow |
| 7,255,344 | B2 | 8/2007 | Grauzer et al. |
| 7,255,351 | B2 | 8/2007 | Yoseloff et al. |
| 7,255,642 | B2 | 8/2007 | Sines et al. |
| 7,257,630 | B2 | 8/2007 | Cole et al. |
| 7,261,294 | B2 | 8/2007 | Grauzer et al. |
| 7,264,241 | B2 | 9/2007 | Schubert et al. |
| 7,264,243 | B2 | 9/2007 | Yoseloff et al. |
| 7,277,570 | B2 | 10/2007 | Armstrong |
| 7,278,923 | B2 | 10/2007 | Grauzer et al. |
| 7,294,056 | B2 | 11/2007 | Lowell et al. |
| 7,297,062 | B2 | 11/2007 | Gatto et al. |
| 7,300,056 | B2 | 11/2007 | Gioia et al. |
| 7,303,473 | B2 | 12/2007 | Rowe |
| 7,303,475 | B2 | 12/2007 | Britt et al. |
| 7,309,065 | B2 | 12/2007 | Yoseloff et al. |
| 7,316,609 | B2 | 1/2008 | Dunn et al. |
| 7,316,615 | B2 | 1/2008 | Soltys et al. |
| 7,322,576 | B2 | 1/2008 | Grauzer et al. |
| 7,331,579 | B2 | 2/2008 | Snow |
| 7,334,794 | B2 | 2/2008 | Snow |
| 7,338,044 | B2 | 3/2008 | Grauzer et al. |
| 7,338,362 | B1 | 3/2008 | Gallagher |
| 7,341,510 | B2 | 3/2008 | Bourbour et al. |
| D566,784 | S | 4/2008 | Palmer |
| 7,357,321 | B2 | 4/2008 | Yoshida |
| 7,360,094 | B2 | 4/2008 | Neff |
| 7,367,561 | B2 | 5/2008 | Blaha et al. |
| 7,367,563 | B2 | 5/2008 | Yoseloff et al. |
| 7,367,565 | B2 | 5/2008 | Chiu |
| 7,367,884 | B2 | 5/2008 | Breeding et al. |
| 7,374,170 | B2 | 5/2008 | Grauzer et al. |
| 7,384,044 | B2 | 6/2008 | Grauzer et al. |
| 7,387,300 | B2 | 6/2008 | Snow |
| 7,389,990 | B2 | 6/2008 | Mourad |
| 7,390,256 | B2 | 6/2008 | Soltys et al. |
| 7,399,226 | B2 | 7/2008 | Mishra |
| 7,407,438 | B2 | 8/2008 | Schubert et al. |
| 7,413,191 | B2 | 8/2008 | Grauzer et al. |
| 7,434,805 | B2 | 10/2008 | Grauzer et al. |
| 7,436,957 | B1 | 10/2008 | Fisher et al. |
| 7,448,626 | B2 | 11/2008 | Fleckenstein |
| 7,458,582 | B2 | 12/2008 | Snow et al. |
| 7,461,843 | B1 | 12/2008 | Baker et al. |
| 7,464,932 | B2 | 12/2008 | Darling |
| 7,464,934 | B2 | 12/2008 | Schwartz |
| 7,472,906 | B2 | 1/2009 | Shai |
| 7,478,813 | B1 | 1/2009 | Hofferber et al. |
| 7,500,672 | B2 | 3/2009 | Ho |
| 7,506,874 | B2 | 3/2009 | Hall |
| 7,510,186 | B2 | 3/2009 | Fleckenstein |
| 7,510,190 | B2 | 3/2009 | Snow et al. |
| 7,510,194 | B2 | 3/2009 | Soltys et al. |
| 7,510,478 | B2 | 3/2009 | Benbrahim et al. |
| 7,513,437 | B2 | 4/2009 | Douglas |
| 7,515,718 | B2 | 4/2009 | Nguyen et al. |
| 7,523,935 | B2 | 4/2009 | Grauzer et al. |
| 7,523,936 | B2 | 4/2009 | Grauzer et al. |
| 7,523,937 | B2 | 4/2009 | Fleckenstein |
| 7,525,510 | B2 | 4/2009 | Beland et al. |
| 7,537,216 | B2 | 5/2009 | Soltys et al. |
| 7,540,497 | B2 | 6/2009 | Tseng |
| 7,540,498 | B2 | 6/2009 | Crenshaw et al. |
| 7,549,643 | B2 | 6/2009 | Quach |
| 7,554,753 | B2 | 6/2009 | Wakamiya |
| 7,556,197 | B2 | 7/2009 | Yoshida |
| 7,556,266 | B2 | 7/2009 | Blaha et al. |
| 7,575,237 | B2 | 8/2009 | Snow |
| 7,578,506 | B2 | 8/2009 | Lambert |
| 7,584,962 | B2 | 9/2009 | Breeding et al. |
| 7,584,963 | B2 | 9/2009 | Krenn et al. |
| 7,584,966 | B2 | 9/2009 | Snow |
| 7,591,728 | B2 | 9/2009 | Gioia et al. |
| 7,593,544 | B2 | 9/2009 | Downs |
| 7,594,660 | B2 | 9/2009 | Baker et al. |
| 7,597,623 | B2 | 10/2009 | Grauzer et al. |
| 7,644,923 | B1 | 1/2010 | Dickinson et al. |
| 7,661,676 | B2 | 2/2010 | Smith et al. |
| 7,666,090 | B2 | 2/2010 | Hettinger |
| 7,669,852 | B2 | 3/2010 | Baker et al. |
| 7,669,853 | B2 | 3/2010 | Jones |
| 7,677,565 | B2 | 3/2010 | Grauzer et al. |
| 7,677,566 | B2 | 3/2010 | Krenn et al. |
| 7,686,681 | B2 | 3/2010 | Soltys et al. |
| 7,699,694 | B2 | 4/2010 | Hill |
| 7,735,657 | B2 | 6/2010 | Johnson |
| 7,740,244 | B2 | 6/2010 | Ho |
| 7,744,452 | B2 | 6/2010 | Cimring et al. |
| 7,753,373 | B2 | 7/2010 | Grauzer et al. |
| 7,753,374 | B2 | 7/2010 | Ho |
| 7,753,798 | B2 | 7/2010 | Soltys |
| 7,758,425 | B2 | 7/2010 | Poh et al. |
| 7,762,554 | B2 | 7/2010 | Ho |
| 7,764,836 | B2 | 7/2010 | Downs et al. |
| 7,766,332 | B2 | 8/2010 | Grauzer et al. |
| 7,766,333 | B1 | 8/2010 | Stardust |
| 7,769,232 | B2 | 8/2010 | Downs, III |
| 7,769,853 | B2 | 8/2010 | Nezamzadeh |
| 7,773,749 | B1 | 8/2010 | Durst et al. |
| 7,780,529 | B2 | 8/2010 | Rowe et al. |
| 7,784,790 | B2 | 8/2010 | Grauzer et al. |
| 7,804,982 | B2 | 9/2010 | Howard et al. |
| 7,824,255 | B2 | 11/2010 | Lutnick |
| 7,846,020 | B2 | 12/2010 | Walker et al. |

(56) References Cited

U.S. PATENT DOCUMENTS 7,867,080 B2 1/2011 Nicely et al.
7,890,365 B2 2/2011 Hettinger
7,900,923 B2 3/2011 Toyama et al.
7,901,285 B2 3/2011 Tran et al.
7,908,169 B2 3/2011 Hettinger
7,909,689 B2 3/2011 Lardie
7,933,448 B2 4/2011 Downs, III
7,946,586 B2 5/2011 Krenn et al.
7,959,153 B2 6/2011 Franks, Jr.
7,967,294 B2 6/2011 Blaha et al.
7,976,023 B1 7/2011 Hessing et al.
7,931,533 B2 8/2011 LeMay et al.
7,988,152 B2 8/2011 Sines et al.
7,988,554 B2 8/2011 LeMay et al.
7,995,196 B1 8/2011 Fraser
8,002,638 B2 8/2011 Grauzer et al.
8,011,661 B2 9/2011 Stasson
8,016,663 B2 9/2011 Soltys et al.
8,021,231 B2 9/2011 Walker et al.
8,025,294 B2 9/2011 Grauzer et al.
8,038,521 B2 10/2011 Grauzer et al.
RE42,944 E 11/2011 Blaha et al.
8,057,302 B2 11/2011 Wells et al.
8,062,134 B2 11/2011 Kelly et al.
8,070,574 B2 12/2011 Grauzer et al.
8,092,307 B2 1/2012 Kelly
8,092,309 B2 1/2012 Bickley
8,109,514 B2 2/2012 Toyama
8,141,875 B2 3/2012 Grauzer et al.
8,150,158 B2 4/2012 Downs, III
8,171,567 B1 5/2012 Fraser et al.
8,210,536 B2 7/2012 Blaha et al.
8,221,244 B2 7/2012 French
8,251,293 B2 8/2012 Nagata et al.
8,267,404 B2 9/2012 Grauzer et al.
8,270,603 B1 9/2012 Durst et al.
8,287,347 B2 10/2012 Snow et al.
8,287,386 B2 10/2012 Miller et al.
8,319,666 B2 11/2012 Weinmann et al.
8,337,296 B2 12/2012 Grauzer et al.
8,342,525 B2 1/2013 Scheper et al.
8,342,526 B1 1/2013 Sampson
8,342,529 B2 1/2013 Snow
8,353,513 B2 1/2013 Swanson
8,381,918 B2 2/2013 Johnson
8,419,521 B2 4/2013 Grauzer et al.
8,429,229 B2 4/2013 Sepich et al.
8,444,147 B2 5/2013 Grauzer et al.
8,444,489 B2 5/2013 Lian et al.
8,469,360 B2 6/2013 Sines
8,475,252 B2 7/2013 Savage et al.
8,480,088 B2 7/2013 Toyama et al.
8,485,527 B2 7/2013 Sampson et al.
8,490,973 B2 7/2013 Yoseloff et al.
8,498,444 B2 7/2013 Sharma
8,505,916 B2 8/2013 Grauzer et al.
8,511,684 B2 8/2013 Grauzer et al.
8,512,146 B2 8/2013 Gururajan et al.
8,550,464 B2 10/2013 Soltys et al.
8,556,263 B2 10/2013 Grauzer et al.
8,579,289 B2 11/2013 Rynda et al.
8,602,416 B2 12/2013 Toyama
8,616,552 B2 12/2013 Czyzewski et al.
8,628,086 B2 1/2014 Krenn et al.
8,651,485 B2 2/2014 Stasson
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,777,710 B2 7/2014 Grauzer et al.
8,820,745 B2 9/2014 Grauzer et al.
8,844,930 B2 9/2014 Sampson
8,899,587 B2 12/2014 Grauzer et al.
8,919,775 B2 12/2014 Wadds et al.
9,101,821 B2 8/2015 Snow
9,251,661 B2 2/2016 Tammesoo
9,266,012 B2 2/2016 Grauzer
9,280,866 B2 3/2016 Nayak et al.
9,378,766 B2 6/2016 Kelly et al.
9,474,957 B2 10/2016 Haushalter et al.
9,504,905 B2 11/2016 Kelly et al.
9,511,274 B2 12/2016 Kelly et al.
9,566,501 B2 2/2017 Stasson et al.
9,679,603 B2 6/2017 Kelly et al.
9,731,190 B2 8/2017 Sampson et al.
9,993,719 B2 * 6/2018 Krenn ..... A63F 1/12
2001/0036231 A1 11/2001 Easwar et al.
2001/0036866 A1 11/2001 Stockdale et al.
2001/0054576 A1 12/2001 Stardust et al.
2002/0017481 A1 2/2002 Johnson et al.
2002/0045478 A1 4/2002 Soltys et al.
2002/0045481 A1 4/2002 Soltys et al.
2002/0063389 A1 5/2002 Breeding et al.
2002/0068635 A1 6/2002 Hill
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer
2003/0047870 A1 3/2003 Blaha et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0071413 A1 4/2003 Blaha et al.
2003/0073498 A1 4/2003 Grauzer et al.
2003/0075865 A1 4/2003 Grauzer et al.
2003/0075866 A1 4/2003 Blaha et al.
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0036214 A1 2/2004 Baker et al.
2004/0067789 A1 4/2004 Grauzer et al.
2004/0100026 A1 5/2004 Haggard
2004/0108654 A1 6/2004 Grauzer et al.
2004/0116179 A1 6/2004 Nicely et al.
2004/0169332 A1 9/2004 Grauzer et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0023752 A1 2/2005 Grauzer et al.
2005/0026680 A1 2/2005 Gururajan
2005/0035548 A1 2/2005 Yoseloff
2005/0037843 A1 2/2005 Wells et al.
2005/0040594 A1 2/2005 Krenn et al.
2005/0051955 A1 3/2005 Schubert et al.
2005/0051956 A1 3/2005 Grauzer et al.
2005/0062227 A1 3/2005 Grauzer et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.
2005/0104289 A1 5/2005 Grauzer et al.
2005/0104290 A1 5/2005 Grauzer et al.
2005/0110210 A1 5/2005 Soltys et al.

(56) References Cited

U.S. PATENT DOCUMENTS

| | | | |
|---|---|---|---|
| 2005/0113166 | A1 | 5/2005 | Grauzer et al. |
| 2005/0113171 | A1 | 5/2005 | Hodgson |
| 2005/0119048 | A1 | 6/2005 | Soltys |
| 2005/0121852 | A1 | 6/2005 | Soltys et al. |
| 2005/0137005 | A1 | 6/2005 | Soltys et al. |
| 2005/0140090 | A1 | 6/2005 | Breeding et al. |
| 2005/0146093 | A1 | 7/2005 | Grauzer et al. |
| 2005/0148391 | A1 | 7/2005 | Tain |
| 2005/0164759 | A1 | 7/2005 | Smith et al. |
| 2005/0164761 | A1 | 7/2005 | Tain |
| 2005/0192092 | A1 | 9/2005 | Breckner et al. |
| 2005/0206077 | A1 | 9/2005 | Grauzer et al. |
| 2005/0242500 | A1 | 11/2005 | Downs |
| 2005/0272501 | A1 | 12/2005 | Tran et al. |
| 2005/0277463 | A1 | 12/2005 | Knust |
| 2005/0288083 | A1 | 12/2005 | Downs |
| 2005/0288086 | A1 | 12/2005 | Schubert et al. |
| 2006/0027970 | A1 | 2/2006 | Kyrychenko |
| 2006/0033269 | A1 | 2/2006 | Grauzer et al. |
| 2006/0033270 | A1 | 2/2006 | Grauzer et al. |
| 2006/0046853 | A1 | 3/2006 | Black |
| 2006/0063577 | A1 | 3/2006 | Downs, III et al. |
| 2006/0066048 | A1 | 3/2006 | Krenn et al. |
| 2006/0084502 | A1 | 4/2006 | Downs et al. |
| 2006/0151946 | A1 | 7/2006 | Ngai |
| 2006/0181022 | A1 | 8/2006 | Grauzer et al. |
| 2006/0183540 | A1 | 8/2006 | Grauzer et al. |
| 2006/0189381 | A1 | 8/2006 | Daniel et al. |
| 2006/0199649 | A1 | 9/2006 | Soltys et al. |
| 2006/0205508 | A1 | 9/2006 | Green |
| 2006/0220312 | A1 | 10/2006 | Baker et al. |
| 2006/0220313 | A1 | 10/2006 | Baker et al. |
| 2006/0252521 | A1 | 11/2006 | Gururajan et al. |
| 2006/0252554 | A1 | 11/2006 | Gururajan et al. |
| 2006/0279040 | A1 | 12/2006 | Downs et al. |
| 2006/0281534 | A1 | 12/2006 | Grauzer et al. |
| 2007/0001395 | A1 | 1/2007 | Gioia et al. |
| 2007/0006708 | A1 | 1/2007 | Laakso |
| 2007/0015583 | A1 | 1/2007 | Tran |
| 2007/0018389 | A1 | 1/2007 | Downs, III |
| 2007/0045959 | A1 | 3/2007 | Soltys |
| 2007/0049368 | A1 | 3/2007 | Kuhn et al. |
| 2007/0057454 | A1 | 3/2007 | Fleckenstein |
| 2007/0057469 | A1 | 3/2007 | Grauzer et al. |
| 2007/0066387 | A1 | 3/2007 | Matsuno et al. |
| 2007/0069462 | A1 | 3/2007 | Downs, III et al. |
| 2007/0072677 | A1 | 3/2007 | Lavoie et al. |
| 2007/0102879 | A1 | 5/2007 | Stasson |
| 2007/0111773 | A1 | 5/2007 | Gururajan et al. |
| 2007/0184905 | A1 | 8/2007 | Gatto et al. |
| 2007/0197294 | A1 | 8/2007 | Gong |
| 2007/0197298 | A1 | 8/2007 | Rowe |
| 2007/0202941 | A1 | 8/2007 | Miltenberger et al. |
| 2007/0222147 | A1 | 9/2007 | Blaha et al. |
| 2007/0225055 | A1 | 9/2007 | Weisman |
| 2007/0233567 | A1 | 10/2007 | Daly |
| 2007/0238506 | A1 | 10/2007 | Ruckle |
| 2007/0241498 | A1 | 10/2007 | Soltys |
| 2007/0259709 | A1 | 11/2007 | Kelly et al. |
| 2007/0267812 | A1 | 11/2007 | Grauzer et al. |
| 2007/0272600 | A1 | 11/2007 | Johnson |
| 2007/0278739 | A1 | 12/2007 | Swanson |
| 2007/0287534 | A1 | 12/2007 | Fleckenstein |
| 2007/0290438 | A1 | 12/2007 | Grauzer et al. |
| 2007/0298865 | A1 | 12/2007 | Soltys |
| 2008/0004107 | A1 | 1/2008 | Nguyen et al. |
| 2008/0006997 | A1 | 1/2008 | Scheper et al. |
| 2008/0006998 | A1 | 1/2008 | Grauzer et al. |
| 2008/0022415 | A1 | 1/2008 | Kuo et al. |
| 2008/0032763 | A1 | 2/2008 | Giobbi |
| 2008/0039192 | A1 | 2/2008 | Laut |
| 2008/0039208 | A1 | 2/2008 | Abrink et al. |
| 2008/0096656 | A1 | 4/2008 | LeMay et al. |
| 2008/0111300 | A1 | 5/2008 | Czyzewski et al. |
| 2008/0113700 | A1 | 5/2008 | Czyzewski et al. |
| 2008/0113783 | A1 | 5/2008 | Czyzewski et al. |
| 2008/0136108 | A1 | 6/2008 | Polay |
| 2008/0143048 | A1 | 6/2008 | Shigeta |
| 2008/0176627 | A1 | 7/2008 | Lardie |
| 2008/0217218 | A1 | 9/2008 | Johnson |
| 2008/0234046 | A1 | 9/2008 | Kinsley |
| 2008/0234047 | A1 | 9/2008 | Nguyen |
| 2008/0248875 | A1 | 10/2008 | Beatty |
| 2008/0284096 | A1 | 11/2008 | Toyama et al. |
| 2008/0303210 | A1 | 12/2008 | Grauzer et al. |
| 2008/0315517 | A1 | 12/2008 | Toyama et al. |
| 2009/0026700 | A2 | 1/2009 | Shigeta |
| 2009/0048026 | A1 | 2/2009 | French |
| 2009/0054161 | A1 | 2/2009 | Schuber et al. |
| 2009/0072477 | A1 | 3/2009 | Tseng et al. |
| 2009/0121429 | A1 | 3/2009 | Walsh et al. |
| 2009/0091078 | A1 | 4/2009 | Grauzer et al. |
| 2009/0100409 | A1 | 4/2009 | Toneguzzo |
| 2009/0104963 | A1 | 4/2009 | Burman |
| 2009/0134575 | A1 | 5/2009 | Dickinson et al. |
| 2009/0140492 | A1 | 6/2009 | Yoseloff et al. |
| 2009/0166970 | A1 | 7/2009 | Rosh et al. |
| 2009/0176547 | A1 | 7/2009 | Katz |
| 2009/0179378 | A1 | 7/2009 | Amaitis et al. |
| 2009/0186676 | A1 | 7/2009 | Amaitis et al. |
| 2009/0189346 | A1 | 7/2009 | Krenn et al. |
| 2009/0191933 | A1 | 7/2009 | French |
| 2009/0194988 | A1 | 8/2009 | Wright et al. |
| 2009/0197662 | A1 | 8/2009 | Wright et al. |
| 2009/0224476 | A1 | 9/2009 | Grauzer et al. |
| 2009/0227318 | A1 | 9/2009 | Wright et al. |
| 2009/0227360 | A1 | 9/2009 | Gioia et al. |
| 2009/0250873 | A1 | 10/2009 | Jones |
| 2009/0253478 | A1 | 10/2009 | Walker et al. |
| 2009/0253503 | A1 | 10/2009 | Krise et al. |
| 2009/0267296 | A1 | 10/2009 | Ho et al. |
| 2009/0267297 | A1 | 10/2009 | Blaha et al. |
| 2009/0283969 | A1 | 11/2009 | Tseng et al. |
| 2009/0298577 | A1 | 12/2009 | Gagner et al. |
| 2009/0302535 | A1 | 12/2009 | Ho et al. |
| 2009/0302537 | A1 | 12/2009 | Ho et al. |
| 2009/0312093 | A1 | 12/2009 | Walker et al. |
| 2009/0314188 | A1 | 12/2009 | Toyama et al. |
| 2010/0013152 | A1 | 1/2010 | Grauzer |
| 2010/0038849 | A1 | 2/2010 | Scheper et al. |
| 2010/0048304 | A1 | 2/2010 | Boesen |
| 2010/0069155 | A1 | 3/2010 | Schwartz et al. |
| 2010/0178987 | A1 | 7/2010 | Pacey |
| 2010/0197410 | A1 | 8/2010 | Leen et al. |
| 2010/0234110 | A1 | 9/2010 | Clarkson |
| 2010/0240440 | A1 | 9/2010 | Szrek et al. |
| 2010/0244376 | A1 | 9/2010 | Johnson |
| 2010/0244382 | A1 | 9/2010 | Snow |
| 2010/0252992 | A1 | 10/2010 | Sines |
| 2010/0255899 | A1 | 10/2010 | Paulsen |
| 2010/0276880 | A1 | 11/2010 | Grauzer et al. |
| 2010/0311493 | A1 | 12/2010 | Miller et al. |
| 2010/0311494 | A1 | 12/2010 | Miller et al. |
| 2010/0314830 | A1 | 12/2010 | Grauzer et al. |
| 2010/0320685 | A1 | 12/2010 | Grauzer |
| 2011/0006480 | A1 | 1/2011 | Grauzer |
| 2011/0012303 | A1 | 1/2011 | Kourgiantakis et al. |
| 2011/0024981 | A1 | 2/2011 | Tseng |
| 2011/0052049 | A1 | 3/2011 | Rajaraman et al. |
| 2011/0062662 | A1 | 3/2011 | Ohta |
| 2011/0078096 | A1 | 3/2011 | Bounds |
| 2011/0079959 | A1 | 4/2011 | Hartley |
| 2011/0105208 | A1 | 5/2011 | Bickley |
| 2011/0109042 | A1 | 5/2011 | Rynda |
| 2011/0130185 | A1 | 6/2011 | Walker |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0183748 | A1 | 7/2011 | Wilson et al. |
| 2011/0230148 | A1 | 9/2011 | Demuynck et al. |
| 2011/0230268 | A1 | 9/2011 | Williams |
| 2011/0269529 | A1 | 11/2011 | Baerlocher |

(56) References Cited

U.S. PATENT DOCUMENTS

| | | | |
|---|---|---|---|
| 2011/0272881 | A1 | 11/2011 | Sines |
| 2011/0285081 | A1 | 11/2011 | Stasson |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0062745 | A1 | 3/2012 | Han et al. |
| 2012/0074646 | A1 | 3/2012 | Grauzer et al. |
| 2012/0091656 | A1 | 4/2012 | Blaha et al. |
| 2012/0095982 | A1 | 4/2012 | Lennington et al. |
| 2012/0161393 | A1 | 6/2012 | Krenn et al. |
| 2012/0175841 | A1 | 7/2012 | Grauzer |
| 2012/0181747 | A1 | 7/2012 | Grauzer et al. |
| 2012/0187625 | A1 | 7/2012 | Downs, III et al. |
| 2012/0242782 | A1 | 9/2012 | Huang |
| 2012/0286471 | A1 | 11/2012 | Grauzer et al. |
| 2012/0306152 | A1 | 12/2012 | Krishnamurty et al. |
| 2013/0020761 | A1 | 1/2013 | Sines et al. |
| 2013/0023318 | A1 | 1/2013 | Abrahamson |
| 2013/0085638 | A1 | 4/2013 | Weinmann et al. |
| 2013/0099448 | A1 | 4/2013 | Scheper et al. |
| 2013/0109455 | A1 | 5/2013 | Grauzer et al. |
| 2013/0132306 | A1 | 5/2013 | Kami et al. |
| 2013/0147116 | A1 | 6/2013 | Stasson |
| 2013/0161905 | A1 | 6/2013 | Grauzer et al. |
| 2013/0228972 | A1 | 9/2013 | Grauzer et al. |
| 2013/0241147 | A1 | 9/2013 | McGrath |
| 2013/0300059 | A1 | 11/2013 | Sampson et al. |
| 2013/0337922 | A1 | 12/2013 | Kuhn |
| 2014/0027979 | A1 | 1/2014 | Stasson et al. |
| 2014/0094239 | A1 | 4/2014 | Grauzer et al. |
| 2014/0103606 | A1 | 4/2014 | Grauzer et al. |
| 2014/0138907 | A1 | 5/2014 | Rynda et al. |
| 2014/0145399 | A1 | 5/2014 | Krenn et al. |
| 2014/0171170 | A1 | 6/2014 | Krishnamurty et al. |
| 2014/0175724 | A1 | 6/2014 | Huhtala et al. |
| 2014/0183818 | A1 | 7/2014 | Czyzewski et al. |
| 2015/0021242 | A1 | 1/2015 | Johnson |
| 2015/0069699 | A1 | 3/2015 | Blazevic |
| 2015/0196834 | A1 | 7/2015 | Snow |
| 2015/0238848 | A1 | 8/2015 | Kuhn et al. |
| 2015/0251079 | A1 | 9/2015 | Wright |
| 2017/0157499 | A1 | 6/2017 | Krenn et al. |
| 2018/0085658 | A1 | 3/2018 | Helsen et al. |
| 2018/0089956 | A1 | 3/2018 | Nagaragatta et al. |
| 2018/0200610 | A1 | 7/2018 | Riordan et al. |

FOREIGN PATENT DOCUMENTS

| | | | |
|---|---|---|---|
| AU | 697805 | B2 | 10/1998 |
| AU | 757636 | B2 | 2/2003 |
| CA | 2266555 | A1 | 9/1996 |
| CA | 2284017 | A1 | 9/1998 |
| CA | 2612138 | A1 | 12/2006 |
| CN | 2051521 | U | 1/1990 |
| CN | 1383099 | A | 12/2002 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 1771077 | B | 6/2010 |
| CN | 102125756 | A | 7/2011 |
| CN | 102170944 | A | 8/2011 |
| CN | 101783011 | B | 12/2011 |
| CN | 102847311 | A | 1/2013 |
| CN | 202724641 | U | 2/2013 |
| CN | 202983149 | U | 6/2013 |
| CZ | 24952 | U1 | 2/2013 |
| DE | 0291230 | C | 4/1916 |
| DE | 2816377 | A1 | 10/1979 |
| DE | 3807127 | A1 | 9/1989 |
| DE | 2757341 | A1 | 9/1998 |
| EP | 0777514 | B1 | 2/2000 |
| EP | 1502631 | A1 | 2/2005 |
| EP | 1713026 | A1 | 10/2006 |
| EP | 1194888 | A1 | 8/2009 |
| EP | 2228106 | A1 | 9/2010 |
| EP | 1575261 | B1 | 8/2012 |
| FR | 2375918 | A1 | 7/1978 |
| GB | 289552 | A | 4/1928 |
| GB | 337147 | A | 9/1929 |
| GB | 414014 | A | 7/1934 |
| GB | 672616 | A | 5/1952 |
| JP | 10063933 | A | 3/1998 |
| JP | 11045321 | A | 2/1999 |
| JP | 2000251031 | A | 9/2000 |
| JP | 2001327647 | A | 11/2001 |
| JP | 2002165916 | A | 6/2002 |
| JP | 2003-154320 | A | 5/2003 |
| JP | 2003250950 | A | 9/2003 |
| JP | 2005198668 | A | 7/2005 |
| JP | 2008246061 | A | 10/2008 |
| JP | 4586474 | B2 | 11/2010 |
| TW | M335308 | U | 7/2008 |
| TW | M357307 | U | 5/2009 |
| TW | M359356 | U | 6/2009 |
| TW | I345476 | B | 7/2011 |
| WO | 8700764 | A1 | 2/1987 |
| WO | 9221413 | A1 | 12/1992 |
| WO | 9528210 | A1 | 10/1995 |
| WO | 9607153 | A1 | 3/1996 |
| WO | 9710577 | A1 | 3/1997 |
| WO | 9814249 | A1 | 4/1998 |
| WO | 9840136 | A1 | 9/1998 |
| WO | 9943404 | A1 | 9/1999 |
| WO | 9952610 | A1 | 10/1999 |
| WO | 9952611 | A1 | 10/1999 |
| WO | 200051076 | A1 | 8/2000 |
| WO | 0156670 | A1 | 8/2001 |
| WO | 0178854 | A3 | 10/2001 |
| WO | 0205914 | A1 | 1/2002 |
| WO | 03004116 | A1 | 1/2003 |
| WO | 03026763 | A1 | 4/2003 |
| WO | 2004067889 | A1 | 12/2004 |
| WO | 2004112923 | A1 | 12/2004 |
| WO | 2006031472 | A2 | 3/2006 |
| WO | 2006039308 | A2 | 4/2006 |
| WO | 2008005286 | A2 | 1/2008 |
| WO | 2008006023 | A2 | 1/2008 |
| WO | 2008091809 | A2 | 7/2008 |
| WO | 2009067758 | A1 | 6/2009 |
| WO | 2009137541 | A2 | 11/2009 |
| WO | 2010052573 | A2 | 5/2010 |
| WO | 2010055328 | A2 | 5/2010 |
| WO | 2010117446 | A2 | 10/2010 |
| WO | 2012/053074 | A1 | 4/2012 |
| WO | 2013019677 | A2 | 2/2013 |
| WO | 2016058085 | A9 | 4/2016 |

OTHER PUBLICATIONS

Philippines Patent Application Formality Examination Report—Philippines Patent Application No. 1-2006-000302, dated Jun. 13, 2006.

"Playtech Retail begins roll out of Neon across Grosvenos 55 UK Casinos". Playtech, Apr. 21, 2016. Retrieved on Oct. 11, 2016 from the Internet: <URL: https://www.playtech.com/news/latest_news_

(56) References Cited

OTHER PUBLICATIONS and_prs/playtech_retail_begins_roll_out_of_neon_across_grosvenor_s_55_uk_casinos> (1 page).
Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.
Scarne's Encyclopedia of Games by John Scarne, 1973, "Super Contract Bridge", p. 153.
Shuffle Master Gaming, Service Manual, ACETM Single Deck Card Shuffler, (1998), 63 pages.
Shuffle Master Gaming, Service Manual, Let It Ride Bonus® With Universal Keypad, 112 pages, © 2000 Shuffle Master, Inc.
Service Manual/User Manual for Single Deck Shufflers: BG1, BG2 and BG3 by Shuffle Master © 1997, 151 page.
Singapore Patent Application Examination Report—Singapore Patent Application No. SE 2008 01914 A, dated Jun. 18, 2008, 9 pages.
SHFL Entertainment, Inc. Docket No. 60, Opening Claim Construction Brief, filed in Nevada District Court Case No. 2:12-cv-01782 with exhibits, Aug. 8, 2013, p. 1-125.
Shuffle Master's Reply Memorandum in Support of Shuffle Master's Motion for Preliminary Injunction for *Shuffle Master, Inc.* vs. *VendingData Corporation*, in the U.S. District Court, District of Nevada, No. CV-S-04-1373-JCM-LRL, Nov. 29, 2004.
Statement of Relevance of Cited References, Submitted as Part of a Third-Party Submission Under 37 CFR 1.290 on Dec. 7, 2012 (12 pages).
"TableScanner (TM) from ADVANSYS", Casino Inside Magazine, No. 30, pp. 34-36 (Dec. 2012) (4 pages).
TableScanner "Accounting & Cage". Product Information Datasheets [online]. Advansys, 2013. Retrieved on Oct. 11, 2016 from the Internet: <URL: http://advansys.si/products/tablescanner/accounting-cage/> (4 pages).
TableScanner "Casino Management System". Product Information Datasheets [online]. Advansys, 2013. Retrieved on Oct. 11, 2016 from the Internet: <URL: http://advansys.si/> (6 pages).
TableScanner "Multisite". Product Information Datasheets [online]. Advansys, 2013. Retrieved on Oct. 11, 2016 from the Internet: <URL: http://advansys.si/products/tablescanner/multisite/> (3 pages).
TableScanner "Player Tracking". Product Information Datasheets [online]. Advansys, 2013. Retrieved on Sep. 23, 2016 from the Internet: <URL: http://advansys.si/products/tablescanner/player-tracking/> (4 pages).
TableScanner "Table Management system". Product Information Datasheets [online]. Advansys, 2013. Retrieved on Oct. 11, 2016 from the Internet: <URL: http://advansys.si/products/tablescanner/> (4 pages).
Tbm=pts&hl=en Google Search for card handling device with storage area, card removing system pivoting arm and processor : http://www.google.com/?tbrn=pts&hl=en; Jul. 28, 2012, 2 pages.
Tracking the Tables, by Jack Bularsky, Casino Journal, May 2004, vol. 17, No. 5, pp. 44-47.
"TYM @ A GLANCE—Table Games Yield Management", TYM LIVE Product Information Datasheets [online]. TANGAM Systems, 2016. Retrieved on Oct. 3, 2016 from the Internet: <URL: http://tangamgaming.com/wp-content/uploads/2016/12/TG_TYMGlance_2016-V4-1.pdf> (2 pages).
United States Court of Appeals for the Federal Circuit Decision Decided Dec. 27, 2005 for Preliminary Injuction for *Shuffle Master, Inc.* vs. *VendingData Corporation*, in the U.S. District Court, District of Nevada, No. CV-S-04-1373-JCM-LRL.
VendingData Corporation's Answer and Counterclaim Jury Trial Demanded for *Shuffle Master, Inc.* vs. *VendingData Corporation*, in the U.S. District Court, District of Nevada, No. CV-S-04-1373-JCM-LRL, Oct. 25, 2004.
VendingData Corporation's Opposition to Shuffle Master Inc.'s Motion for Preliminary Injection for *Shuffle Master, Inc.* vs. *VendingData Corporation*, in the U.S. District Court, District of Nevada, No. CV-S-04-1373-JCM-LRL, Nov. 12, 2004.
VendingData Corporation's Responses to Shuffle Master, Inc.'s First set of interrogatories for *Shuffler Master, Inc.* vs. *VendingData Corporation*, in the U.S. District Court, District of Nevada, No. CV-S-04-1373-JCM-LRL, Mar. 14, 2005.
Canadian Office Action for CA 2,580,309 dated Mar. 20, 2012 (6 pages).
Canadian Office Action for Canadian Application No. 2,461,726, dated Jul. 19, 2010, 3 pages.
Canadian Office Action for Canadian Application No. 2,461,726, dated Dec. 11, 2013, 3 pages.
CasinoTrac TableTrac Services. Product Information Datasheet [online]. CasinoTrac, 2015. Retrieved on Oct. 12, 2016 from the Internet: <URL: http://www.tabletrac.com/?pageid=15#prettyPhoto> (3 pages).
Christos Stergiou and Dimitrios Siganos, "Neural Networks," http://www.doc.ic.ac.uk/~nd/surprise_96/journal/vol4/cs11/report.html (13 pages), Dec. 15, 2011.
Complaint filed in the matter of *SHFL entertainment, In.* v. *DigiDeal Corporation*, U.S. District Court, District of Nevada, Civil Action No. CV 2:12-cv-01782-GMC-VCF, Oct. 10, 2012, 62 pages.
CONNECT2TABLE Administrator Manual, Jan. 7, 2013 (82 pages).
CONNECT2TABLE Quick Installation Guide, Feb. 20, 2013 (36 pages).
CONNECT2TABLE Connect2Table System Summary, generated Oct. 21, 2016 (2 pages).
CONNECT2TABLE User Manual, Feb. 7, 2013 (35 pages).
European Search Report for European Application No. 12 152 303, dated Apr. 16, 2012, 3 pages.
European Patent Application Search Report—European Patent Application No. 06772987.1, dated Dec. 10, 2009, 5 pages.
European Examination Report for European Application No. 02 780 410, dated Jan. 25, 2010, 5 pages.
European Examination Report for European Application No. 02 780 410, dated Aug. 9, 2011, 4 pages.
Fine, Randall A., "Talking Tables", dated Apr. 25, 2012. Global Gaming Business Magazine, vol. 11, No. 5, May 2012. Retrieved on Oct. 3, 2016 from the Internet: <URL: https://ggbmagazine.com/issue/vol-11-no-5-may-2012/article/talking-tables> (4 pages).
Genevieve Orr, CS-449: Neural Networks Willamette University, http://www.willamette.edu/~gorr/classes/cs449/intro.html (4 pages), Fall 1999.
http://www.google.com/search?tbm=pts&q=Card+handling+devicve+with+input+and+outpu.. Jun. 8, 2012.
http://www.ildado.com/casino_glossary.html, Feb. 1, 2001, p. 1-8.
https://web.archive.org/web/19991004000323/http://travelwizardtravel.com/majon.htm, Oct. 4, 1999, 2 pages.
http://www.google.com/search?tbm=pts&q=shuffling+zone+onOopposite+site+of+input+ . . . Jul. 18, 2012.
Litwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI 20062710, May 9, 2009, 4 pages.
NEON Product Information Datasheets [online]. "Enterprise Casino Management, Table Management System, Mobile, Gaming". Intelligent Gaming, 2014. Retrieved on Oct. 12, 2016 from the Internet: <URL: http://www.intelligentgaming.co.uk/products/neon-enterprise/> (4 pages).
PCT International Preliminary Examination Report for International Patent Application No. PCT/US02/31105 dated Jul. 28, 2004, 9 pages.
PCT International Search Report for International Application No. PCT/US2003/015393, dated Oct. 6, 2003, 2 pages.
PCT International Search Report and Written Opinion, PCT/US2012/48706, dated Oct. 16, 2012, 12 pages.
PCT International Search Report for PCT/US2005/034737 dated Apr. 7, 2006, 1 page (WO06/039308).
PCT International Search Report for PCT/US2007/022894, dated Jun. 11, 2008, 3 pages.
PCT International Search Report and Written Opinion of the International Searching Authority for PCT/US2010/001032, dated Jun. 16, 2010, 11 pages.
PCT International Search Report and Written Opinion for PCT/US07/15035, dated Sep. 29, 2008, 6 pages.

(56) References Cited

OTHER PUBLICATIONS

PCT International Search Report and Written Opinion for PCT/US07/15036, dated Sep. 23, 2008, 6 pages.
PCT International Search Report and Written Opinion, PCT Application No. PCT/US2015/051038, dated Jan. 22, 2016, 11 pages.
PCT International Search Report and Written Opinion of the International Searching Authority for PCT/US2008/007069, dated Sep. 8, 2008, 10 pages.
PCT International Search Report and Written Opinion, PCT Application No. PCT/US2015/022158, dated Jun. 17, 2015, 13 pages.
PCT International Search Report and Written Opinion for International Application No. PCT/US2007/023168, dated Sep. 12, 2008, 8 pages.
PCT International Search Report and Written Opinion, PCT Application No. PCT/US2015/040196, dated Jan. 15, 2016, 20 pages.
PCT International Search Report and Written Opinion, PCT Application No. PCT/US2013/062391, dated Dec. 17, 2013, 13 pages.
PCT International Search Report and Written Opinion of the International Searching Authority for PCT/US05/31400, dated Sep. 25, 2007, 12 pages.
PCT International Search Report and Written Opinion, PCT Application No. PCT/US2015/025420, dated Oct. 2, 2015, 15 pages.
PCT International Search Report and Written Opinion of the International Searching Authority for PCT/US13/59665, dated Apr. 25, 2014, 21 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US11/59797, dated Mar. 27, 2012, 14 pages.
PCT International Search Report and Written Opinion for International Application No. PCT/US2007/022858, dated Mar. 7, 2008, 7 pages.
PCT International Search Report and Written Opinion for International Patent Application No. PCT/US2006/22911, dated Jun. 1, 2007, 6 pages.
PCT International Search Report and Written Opinion of the International Searching Authority for PCT/GB2011/051978, dated Jan. 17, 2012, 11 pages.
International Search Report from International Application No. PCT/EP2016/079630, dated Apr. 28, 2017, 7 pages.
International Written Opinion from International Application No. PCT/EP2016/079630, dated Apr. 28, 2017, 14 pages.
*Shuffle Tech International LLC et al.* vs. *Scientific Games Corporation et al.*, Order Denying Motion for Summary Judgement: Memorandum Opinion and Order, in the U.S. District Court, for the Northern District of Illinois Eastern Division, No. 15 C 3702, Sep. 1, 2017, 35 pages.
Weisenfeld, Bernie; Inventor betting on shuffler; Courier-Post; Sep. 11, 1990; 1 page.
Solberg, Halvard; Deposition; *Shuffle Tech International* v. *Scientific Games Corp., et al.* 1:15-cv-3702 (N.D. III.); Oct. 18, 2016; pp. 187, 224-246, 326-330, 338-339, 396; Baytowne Reporting; Panama City, FL.
Prototype Glossary and Timelines; *Shuffle Tech International* v. *Scientific Games Corp., et al.* 1:15-cv-3702 (N.D. III.); undated; pp. 1-4.
Olsen, Eddie; Automatic Shuffler 'ready' for Atlantic City experiment; Blackjack Confidential; Jul./Aug. 1989; pp. 6-7.
Gros, Roger; New Card Management System to Be Tested at Bally's Park Place; Casino Journal; Apr. 1989; 5 pages.
Gola, Steve; Deposition; *Shuffle Tech International* v. *Scientific Games Corp., et al.* 1:15-cv-3702 (N.D. III.); Oct. 13, 2016; pp. 1, 9-21, 30-69, 150-167, 186-188, 228-231, 290-315, 411; Henderson Legal Services, Inc.; Washington, DC.
1/3" B/W CCD Camera Module EB100 by EverFocus Electronics Corp., Jul. 31, 2001, 3 pgs.
"ACE, Single Deck Shuffler," Shuffle Master, Inc., (2005), 2 pages.
ADVANSYS, "Player Tracking" http://advansys.si/products/tablescanner/player-tracking/[Sep. 23, 2016 1:41:34 PM], 4 pages.
Australian Examination Report for Australian Application No. 2008202752, dated Sep. 25, 2009, 2 pages.
Australian Examination Report for Australian Application No. 2010202856, dated Aug. 11, 2011, 2 pages.
Australian Provisional Patent Application for Australian Patent Application No. PM7441, filed Aug. 15, 1994, Applicants: Rodney G. Johnson et al., Title: Card Handling Apparatus, 13 pages.
"Automatic casino card shuffle," Alibaba.com, (last visited Jul. 22, 2014), 2 pages.
Bally Systems Catalogue, Ballytech.com/systems, 2012, 13 pages.
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 18 of 23 (color copies from Binder 1).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 3 of 23 (Binder 2, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, scan of color pages, for clarity, Part 19 of 23 (color copies from Binder 3).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 6 of 23 (Binder 3, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 20 of 23 (color copies from Binder 4).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 21 of 23 (color copies from Binder 6).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 9 of 23 (Binder 5 having no contents; Binder 6, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 23 (Binder 7, 1 of 2).

(56) References Cited

OTHER PUBLICATIONS

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 22 of 23 (color copies from Binder 8, part 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in case of *Shuffle Master, Inc.* v. *Card Aurstia, et al.*, Case No. CV-N-0508-HDM-(VPC) consolidated with Case No. CV-N-02-0244-ERC-(RAM)), May 6, 2003, scan of color pages, for clarity, Part 23 of 23 (color copies from Binder 8, part 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 23 (Binder 8, 4 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).
DVD labeled Exhibit 1. This is a DVD taken by Shuffle Master personnel of the live operation of a CARD One2Sil Shuffler (Oct. 7, 2003). DVD sent to Examiner by US Postal Service with this PTO/SB/08 form.
DVD labeled Morrill Decl. Ex. A is (see Binder 4-1, p. 149/206, Morrill Decl., para. 2.): A video (16 minutes) that the attorney for CARD, Robert Morrill, made a describe the Roblejo prototype card shuffler. DVD sent to Examiner by US Postal Service with this PTO/SB/08 form.
DVD labeled Solberg Decl.Ex.C, which is not a video at all, is (see Binder 4-1, p. 34/206, Solberg Decl., para.8): Computer source code for operating a computer-controlled card shuffler (an early Roblejo prototype card shuffler) and descriptive comments of how the code works. DVD sent to Examiner by US Postal Service with this PTO/SB/08 form.
DVD labeled Luciano Decl. Ex. K is (see Binder 2-1, p. 215/237, Luciano Decl., para.14): A video demonstration (11minutes) of a Luciano Packaging prototype shuffler. DVD sent to Examiner by US Postal Service with this PTO/SB/08 form.
"Error Back propagation," http://willamette.edu~gorr/classes/cs449/backprop.html (4 pages), Nov. 13, 2008.
"I-Deal," Bally Technologies, Inc., (2014), 2 pages.
"Shufflers—SHFL entertainment," Gaming Concepts Group, (2012), 6 pages.
"TAG Archives: Shuffle Machine," Gee Wiz Online, (Mar. 25, 2013), 4 pages.
European Extended Search Report from European Application No. 19209594.1, dated Feb. 28, 2020, 8 pages.

* cited by examiner

CARD HANDLING DEVICES AND RELATED ASSEMBLIES AND COMPONENTS

CROSS-REFERENCE TO RELATED APPLICATION

This application is a divisional of U.S. patent application Ser. No. 14/959,536, filed Dec. 4, 2015, pending, the disclosure of which is hereby incorporated herein in its entirety by this reference.

TECHNICAL FIELD

The disclosure relates to card handling devices and related assemblies, components, and methods. In particular, embodiments of the disclosure relate to card handling devices, card buffer areas of card handling devices, substantially flat card output areas of card handling devices, and methods of shuffling cards.

BACKGROUND

Wagering games are often based on the outcome of randomly generated arrangements of cards. Such games are widely played in gaming establishments and, often, a single deck or multiple decks of fifty-two (52) playing cards may be used to play the game. Gaming using multiple decks of playing cards may include, for example, six to ten decks used in games such as blackjack and baccarat and two decks of playing cards used in games such as double deck blackjack. Many other specialty games may use single or multiple decks of cards, with or without jokers and with or without selected cards removed.

From the perspective of players, the time the dealer must spend in shuffling diminishes the excitement of the game. From the perspective of casinos, shuffling time reduces the number of hands played and specifically reduces the number of wagers placed and resolved in a given amount of time, consequently reducing casino revenue. Casinos would like to increase the amount of revenue generated by a game without changing the game or adding more tables. One option to increase revenue is to decrease the time the dealer spends handling and shuffling playing cards. This may be accomplished by using one set of cards to administer the game while shuffling a second set of cards. Other options include decreasing shuffling time.

The desire to decrease shuffling time has led to the development of mechanical and electromechanical card shuffling devices. Such devices increase the speed of shuffling and dealing, thereby increasing actual playing time. Such devices also add to the excitement of a game by reducing the amount of time the dealer or house has to spend in preparing to play the game.

However, working with many existing shuffler designs puts unnecessary strain on the muscles of the users (dealers). Using two complete sets of cards also increases the cost of offering the game.

Furthermore, the card output area or shoe used in conjunction with shufflers often places strain on dealers' hands and wrists by using card distribution interfaces to output cards that are oriented at a substantial acute angle relative to the table surface. To draw cards from these shoes, dealers often have to twist their wrists repeatedly at awkward and uncomfortable angles. Moreover, shoes often are not easily adjustable to meet a dealer's card drawing preference (e.g., direction in which dealers prefer to draw a card relative to the table).

Card counting is a significant problem when using automatic card shufflers. Casinos often lose a house advantage when players are able to predict what cards remain to be dealt and the proximity of those cards being dealt. It is desirable for casinos to reduce or eliminate the ability for players to count cards. Continuous shuffling machines assist in reducing the ability to count cards, but additional ways to eliminate card counting and improve ergonomics of card delivery may be desirable.

BRIEF SUMMARY

Some embodiments of the present disclosure include a card handling device having a card shuffling apparatus for shuffling playing cards and a card output portion. The card output portion may include a card buffer area positioned at an interface of the card shuffling apparatus and the card output portion. The card output portion may further be configured to move relative to the card shuffling apparatus in order to alter an orientation of the card buffer area relative to the card shuffling apparatus.

Some embodiments of the present disclosure include a card handling device having a substantially flat card output area. The card handling device may include an interface portion having an at least substantially flat draw surface and a cover disposed over the interface portion. The interface portion and cover may define an outlet between the interface portion and cover. The substantially flat card output area may be configured to permit playing cards to be drawn from the outlet of the of the substantially flat card output area on the draw surface of the interface portion in a plurality of different, at least substantially horizontal directions without first being drawn from the outlet in a direction parallel to a center longitudinal axis of the substantially flat card output.

Some embodiments of the present disclosure include a card handling device having a card shuffling apparatus for shuffling playing cards, a card output area, and a card output portion for receiving playing cards from the card shuffling apparatus and delivering playing cards to the card output area. The card output portion may include a card buffer area positioned within the card handling device at an interface of the card shuffling apparatus and the card output portion. The card buffer area may be configured to temporarily hold a group of playing cards. The card output portion may further include a card feed system configured to remove playing cards one-at-a-time from the card buffer area and to deliver the playing cards one-at-a-time to the substantially flat card output area. The card feed system may be further configured to not send a playing card to the substantially flat card output area until a previously sent playing card is drawn from the substantially flat card output area.

Some embodiments of the present disclosure include a method of shuffling cards. The method may include inputting playing cards into a card input portion of a card handling device, transporting the playing cards from the card input portion into a card shuffling apparatus, outputting at least one playing card from the card shuffling apparatus into a card buffer area, altering an orientation of the card buffer area relative to the card shuffling apparatus, and outputting at least another playing card from the card shuffling apparatus into the card buffer area while the card buffer area is in an altered orientation.

Some embodiments of the present disclosure include a method of shuffling cards. The method may include removing playing cards from a temporary storage area of a card handling device, forming a group of playing cards with the playing cards in a card buffer area of the card handling device, adding at least one playing card to the bottom of the group of playing cards, and adding at least one playing card to the top of the group of playing cards.

Some embodiments of the present disclosure include a method of shuffling cards. The method may include moving playing cards into a card buffer area of a card handling device in a first direction, and moving cards out of the card buffer area in a second direction, wherein the second direction defines an obtuse angle with the first direction.

BRIEF DESCRIPTION OF THE DRAWINGS

The present disclosure may be understood more fully by reference to the following detailed description of example embodiments, which are illustrated in the accompanying figures.

DETAILED DESCRIPTION

Figure 1:
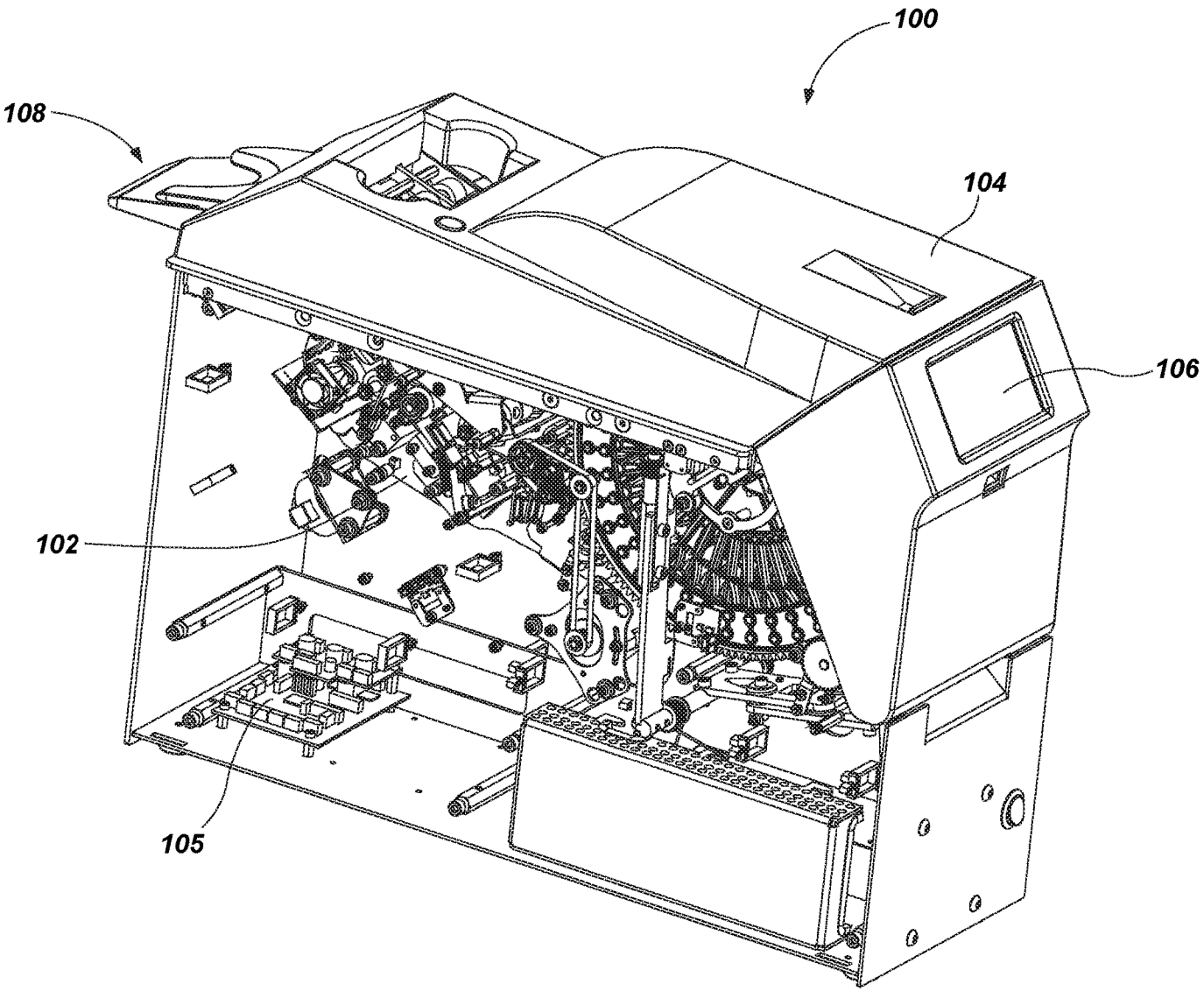
FIG. 1 shows a perspective view of a card handling device, according to an embodiment of the present disclosure, with portions of housings removed to show interior components of the card handling device.

As used herein, any relational term, such as "first," "second," "over," "beneath," "top," "bottom," "underlying," "up," "down," etc., is used for clarity and convenience in understanding the disclosure and accompanying drawings, and does not connote or depend on any specific preference, orientation, or order, except where the context clearly indicates otherwise. For example, these terms may refer to an orientation of elements of the card handling device relative to a surface of a table on which the card handling device may be positioned, mounted, and/or operated (e.g., as illustrated in the figures).

As used herein, the terms "vertical" and "horizontal" may refer to a drawing figure as oriented on the drawing sheet, and are in no way limiting of orientation of an apparatus, or any portion thereof, unless it is apparent that a particular orientation of the apparatus is necessary or desirable for operation in view of gravitational forces. For example, when referring to elements illustrated in the figures, the terms "vertical" or "horizontal" may refer to an orientation of elements of the card handling device relative to a table surface of a table to which the card handling device may be mounted and operated.

Some embodiments of the present disclosure may include card handling devices having "card buffer areas" (e.g., area within the card handling device where playing cards can be temporarily collected). The card handling devices may include a card buffer area that moves relative to a card shuffling apparatus as playing cards are inserted into the card buffer area. As a card buffer area moves, the card shuffling apparatus may insert playing cards at both a top and a bottom of (e.g., beneath) a group of playing cards that is already present in the card buffer area. Some embodiments of the present disclosure may include card handling devices that have playing cards overtake the group of playing cards in the card buffer area. In other words, cards may pass up other cards in the card buffer area such that the cards passing up the other cards are drawn (e.g. dealt) from the card handling device prior to the other cards in the card buffer area. Put another way, playing cards already in the card buffer area may have an order in which the playing cards are going to be dealt from the card handling device, and the card handling device may enable other playing cards to bypass (e.g., jump ahead of in order) the playing cards already in the card buffer area and be dealt prior to the playing cards already in the card buffer area. For example, the card buffer area may have playing cards drawn (to be dealt) from a top a group of playing cards within the card buffer area, and the card buffer area may enable one or more cards to be positioned on top of a stack of cards in the card buffer area (e.g., so that the one or more cards will be drawn before the remaining cards in the card buffer area) or in another position in the stack of cards (e.g., the bottom of the stack).

Some embodiments of the present disclosure may include card handling devices that include a substantially flat card output area (e.g., a substantially flat card delivery area or substantially flat card shoe). The substantially flat card output area may include an interface portion having a surface that is oriented at relatively small acute angles (e.g., 5° to 20°) relative to a table surface of a table to which the card handling device may be positioned and/or mounted. The substantially flat card output area may further allow playing cards to be drawn from an outlet of the substantially flat card output area throughout a range of at least substantially horizontal directions, including directions that are perpendicular to each other.

A perspective view of a card handling device 100, according to an embodiment of the present disclosure, having portions of one or more housings of the card handling device 100 removed to show interior components of the card handling device 100, is shown in FIG. 1. The card handling device 100 may be configured to be mounted with at least a majority of the card handling device 100 beneath a level of a table surface (e.g., a gaming table surface) of a table (e.g., a gaming table) and to deliver shuffled playing cards to the table surface and/or receive playing cards to be shuffled from or proximate the table surface. The card handling device 100 may include a frame structure 102, a housing 104, a control system 105 in communication with a display 106, and a substantially flat card output area 108, relative to the table surface.

Figure 2:
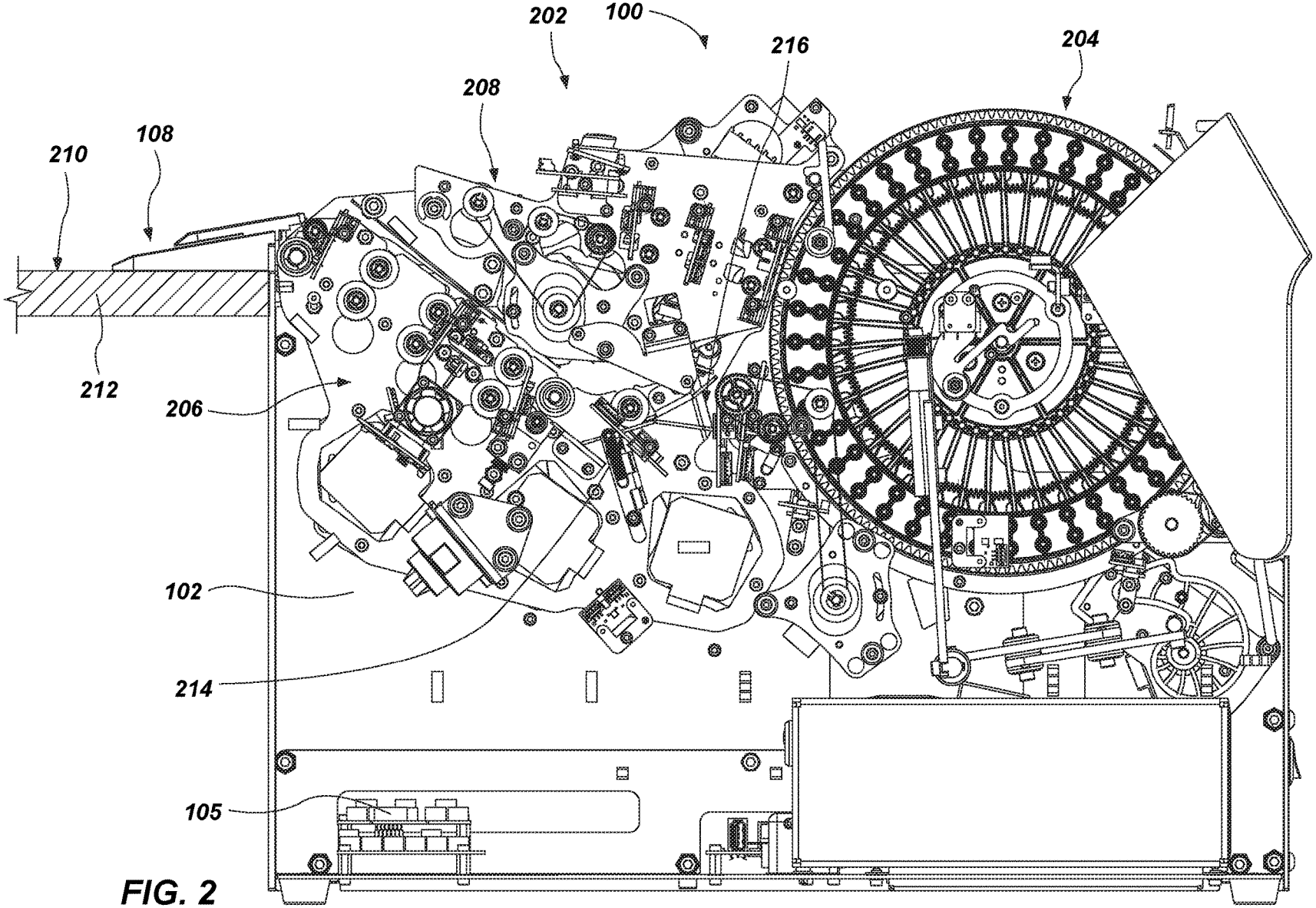
FIG. 2 shows a side elevation view of the card handling device of FIG. 1 with additional portions of housing removed to show interior components of the card handling device.

FIG. 2 shows a side elevation view of the card handling device 100 of FIG. 1 with additional portions of the one or more housings of the card handling device 100 removed to show interior components of the card handling device 100. The card handling device 100 may include a card input portion 202, a card shuffling apparatus 204, and a card output portion 206. The card input portion 202 may include a card intake area 208 for receiving playing cards to be shuffled. The card intake area 208 may be arranged on a same side of the card shuffling apparatus 204 of the card handling device 100 as the substantially flat card output area 108. Furthermore, the card intake area 208 may be oriented to be positioned above and proximate to, such as resting upon, a table surface 210 when the card handling device 100 is mounted to a table 212 and may be accessible to a dealer administering a game at the table 212 to which the card handling device 100 is mounted. As a result, when the card handling device 100 is mounted to a table 212, the substantially flat card output area 108 and card intake area 208 may be oriented proximate in location to each other and to the top surface 210 of the table 212. The orientation of the card intake area 208 of the card input portion 202 and the substantially flat card output area 108 may reduce an amount of the card handling device 100 that needs to be exposed above a table surface 210 of the table 212 to which the card handling device 100 is mounted. The card output portion 206 may include a card buffer area 214 proximate an interface 216 of the card output portion 206 and the card shuffling apparatus 204 of the card handling device 100.

In operation, the card input portion 202 may receive unshuffled playing cards from a table 212 at the card intake area 208 and may deliver the unshuffled playing cards to the card shuffling apparatus 204. The card shuffling apparatus 204 may at least partially shuffle the unshuffled playing cards and may deliver shuffled playing cards to the card buffer area 214 of the card output portion 206 of the card handling device 100. The card output portion 206 may transport playing cards from the card buffer area 214 (e.g., one-at-a-time) to the substantially flat card output area 108 where a dealer may manually draw the playing cards (e.g., one-at-a-time) from the substantially flat card output area 108 for the distribution of cards.

Figure 3:
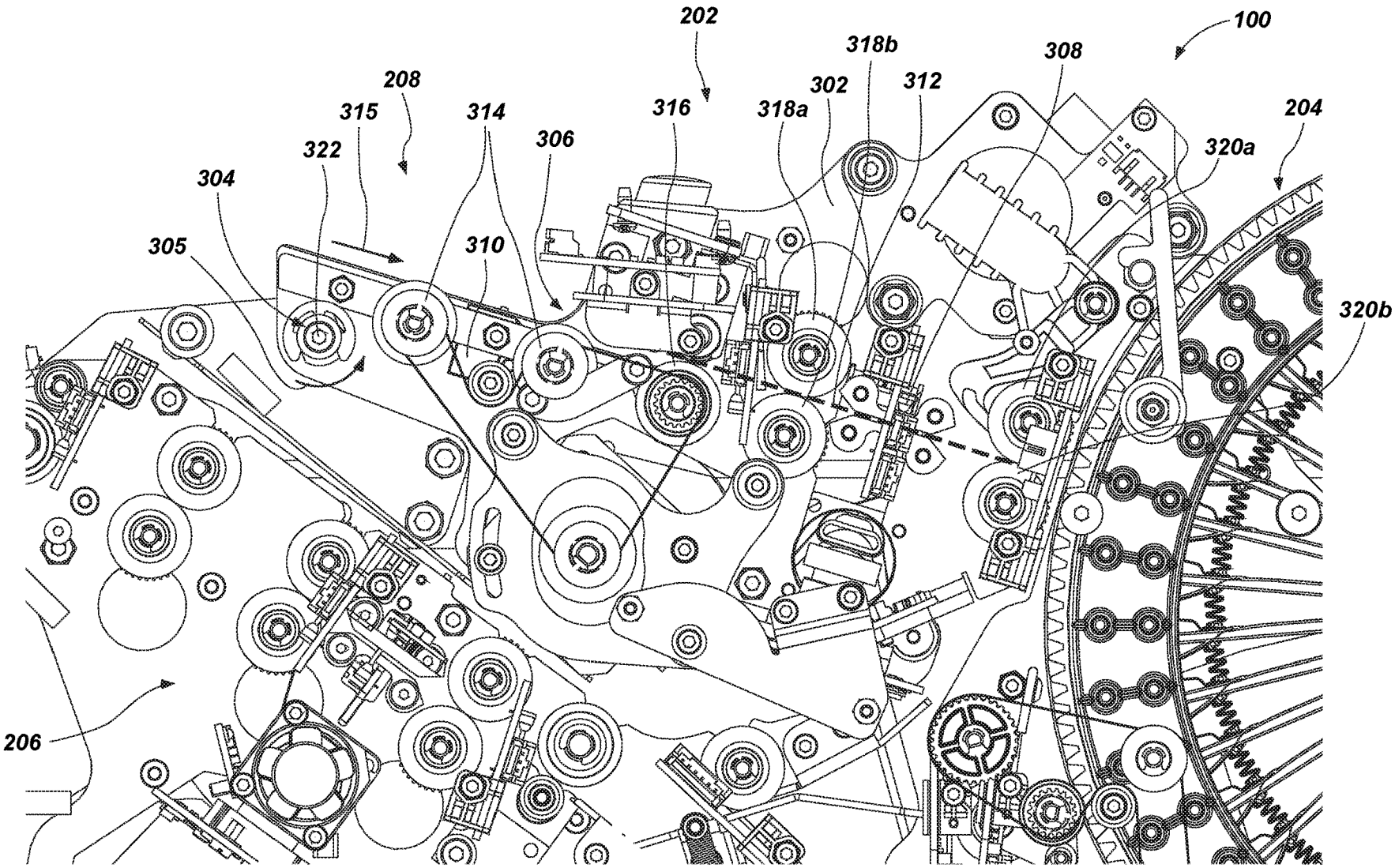
FIG. 3 shows an enlarged side view of a card input portion of the card handling device of FIG. 1.

An enlarged side view of the card input portion 202 of the card handling device 100 as shown in FIG. 2 is shown in FIG. 3. The card input portion 202 may include a first frame assembly 302, a first pivoting axis 304, a first card feed system 306, a first card imaging system 308, and a first sensor 310. The first card feed system 306 may include a first card pathway 312 (e.g., pathway along which playing cards move through the card input portion 202). The first card pathway 312 may lead from the card intake area 208 of the card input portion 202 to the card shuffling apparatus 204 of the card handling device 100. The first card feed system 306 may further have a set of pick-off rollers 314 that transport playing cards individually in a direction indicated by arrow 315. Additional pairs of rollers 316, 318*a*, 318*b*, 320*a*, and 320*b* may displace playing cards from the card intake area 208 to the card shuffling apparatus 204. For example, a stack of unshuffled playing cards may be placed in the card intake area 208, and the set of pick-off rollers 314 of the first card feed system 306 may take playing cards individually from a bottom of (e.g., beneath) the stack of unshuffled playing cards and the additional pairs of rollers 316, 318*a*, 318*b*, 320*a*, 320*b* may transport the playing cards to the card shuffling apparatus 204. In some embodiments, the card intake area 208 may be configured to receive one or more playing cards. In some embodiments, the card intake area 208 may be configured to receive one or more decks of playing cards at a time.

In some embodiments, the first card imaging system 308 may be oriented along the first card pathway 312 of the first card feed system 306. The first card feed system 306 may transport playing cards past the first card imaging system 308, and the first card imaging system 308 may capture identifying information of each playing card as each playing card moves along the first card pathway 312 before insertion into the card shuffling apparatus 204. For example, the first card imaging system 308 may include a camera or line scanning device that captures an image of each card. In some embodiments, the first card imaging system 308 may comprise one or more of the imaging devices described in U.S. Pat. No. 7,933,448 to Downs, issued Apr. 26, 2011, in U.S. Pat. No. 7,764,836 to Downs et al., issued Jul. 27, 2010, or in U.S. Pat. No. 8,800,993 B2 to Blaha et al., issued Aug. 12, 2014, the disclosure of each of which is incorporated herein in its entirety by this reference. In some embodiments, the first card imaging system 308 may not need to capture an image of an entire card, but may detect only rank and suit information, special markings on the playing cards, such as, for example, a lot number, a casino identifier, a shoe number, a shift number, a table number, bar code, glyph, any other known type of special marking, or combinations thereof. In some embodiments, the control system 105 (FIG. 1) of the card handling device 100 may receive signals from the first card imaging system 308 to determine rank and/or suit of each playing card being read or sensed by the first card imaging system 308. The control system 105 (FIG. 1) of the card handling device 100 may store at least some data related to each playing card (e.g., an inventory of the playing cards handled by the card handling device 100, a complete card set composition, etc.) in a memory portion of the control system 105 (FIG. 1). Stored data may be compared to data collected at the first card imaging system 308 or another location in the card handling device 100. For example, the first card imaging system 308 may be used in conjunction with a second card imaging system 508 (FIG. 5A) in the card output portion 206 to keep an inventory of the playing cards maintained in the card shuffling apparatus 204, fed from the card intake area 208 to the card shuffling apparatus 204, and fed from the card shuffling apparatus 204 to the substantially flat card output area 108. In other words, a total inventory of the cards sent through the card handling device 100 may be maintained. Interaction of the first and second card imaging systems 308, 508 is described in further detail in regard to FIG. 5A.

The first sensor 310 of the card input portion 202 may be oriented proximate the card intake area 208 and may be used to sense whether playing cards are present in the card intake area 208. Furthermore, the first sensor 310 may be configured to send signals to and inform the control system 105 (FIG. 1) that playing cards are present in the card intake area 208. Furthermore, the control system 105 (FIG. 1) may be configured to initiate a shuffling cycle (e.g., process of shuffling playing cards with the card handling device 100) when playing cards are placed in the card intake area 208 and sensed by the first sensor 310. In some embodiments, the first sensor 310 may include at least one of an optical sensor and an infrared sensor.

Referring to FIGS. 2 and 3 together, the first pivoting axis 304 of the card input portion 202 may comprise a first shaft 322 rotatably mounted at both ends to the frame structure 102 of the card handling device 100. The first shaft 322 of the first pivoting axis 304 may extend axially along a horizontal plane that is substantially parallel to a table surface 210 of a table 212 to which the card handling device 100 may be mounted. Furthermore, the first pivoting axis 304 of the card input portion 202 may be oriented proximate the card intake area 208 of the card input portion 202 and may be positioned and spaced above a table surface 210 of a table 212 when the card handling device 100 is mounted to a table 212. In some embodiments, the card input portion 202 may be rotatable about the first pivoting axis 304 in a direction represented by arrow 305 relative to the remainder of the card handling device 100. The card input portion 202 may be rotatable away from the card output portion 206 in direction 305 and card shuffling apparatus 204 of the card handling device 100, and the card output portion 206 and card shuffling apparatus 204 may be at least partially exposed when the card input portion 202 is rotated away from the card output portion 206 and card shuffling apparatus 204. For example, during use, the card input portion 202 may be rotated about the first pivoting axis 304 and away from the card output portion 206 and card shuffling apparatus 204 of the card handling device 100 in order to facilitate maintenance, troubleshooting, and/or repair of the card handling device 100. In other words, in FIG. 3, the card output portion 202 may be rotated about the first pivoting axis 304 to expose other portions of the card handling device 100 for maintenance.

Figure 4A:
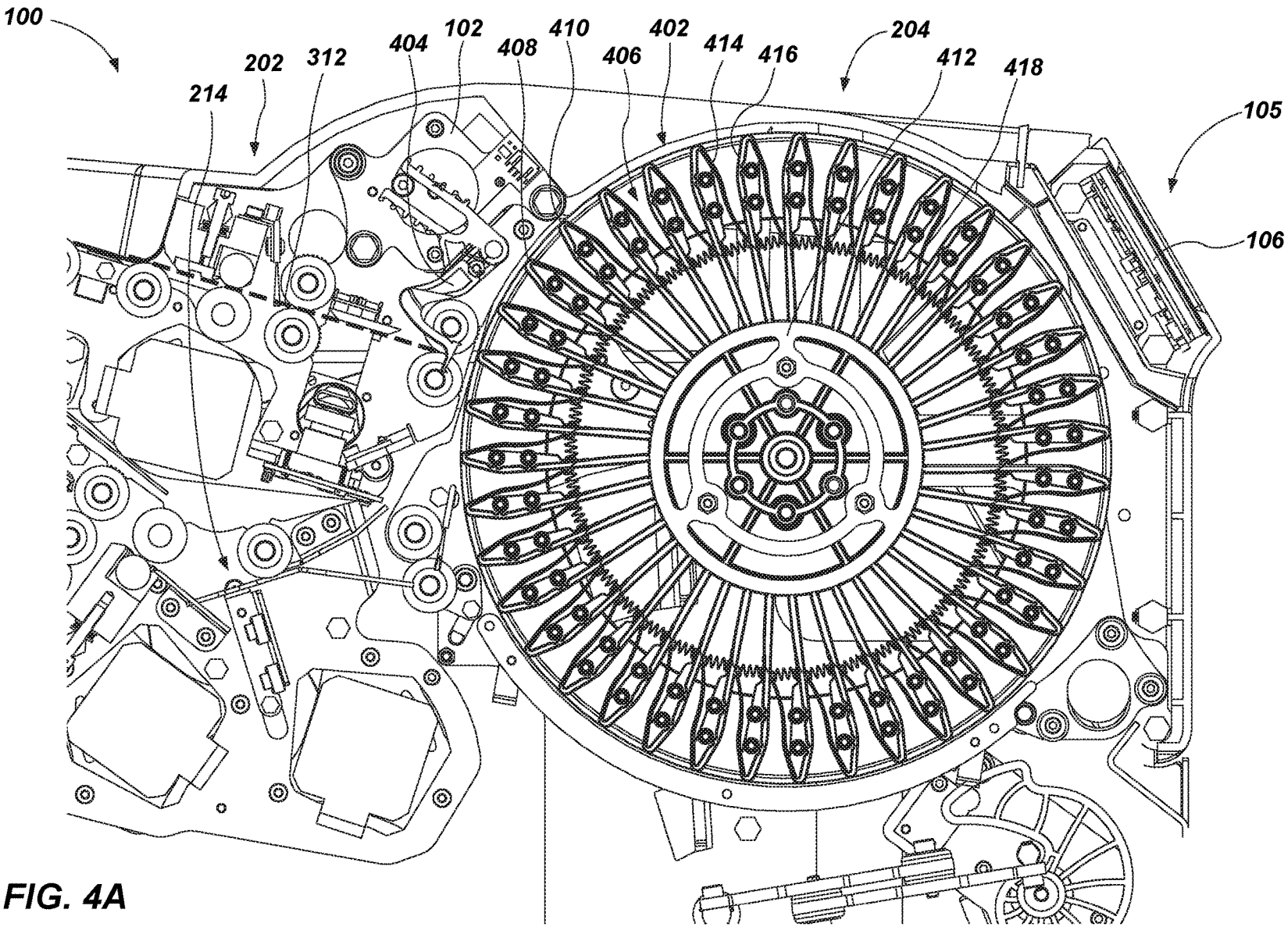
FIG. 4A shows an enlarged side view of a card shuffling apparatus of the card handling device of FIG. 1.

A cross-sectional side view of the card shuffling apparatus 204 of the card handling device 100 of FIG. 1 is shown in FIG. 4A. As shown in FIG. 4A, the card shuffling apparatus 204 may include a multi-compartment carousel 402 and a packer arm device 404. The multi-compartment carousel 402 of the card shuffling apparatus 204 may have a plurality of compartments 406 (e.g., thirty-nine compartments 406) formed between spaced pairs of adjacent fingers 408, 410 extending from a rotatable center member 412. Each compartment 406 of the plurality of compartments 406 may be defined between two spaced pairs of adjacent fingers 408, 410 of the multi-compartment carousel 402. The fingers 408, 410 may each include a beveled edge 414, 416 that enables and guides insertion of playing cards on top of or below playing cards previously deposited in the plurality of compartments 406 by the first card feed system 306 (FIG. 3) of the card input portion 202. The beveled edges 414, 416 may include flat, angled surfaces or curved surfaces. Card edges of playing cards may contact the beveled edges 414, 416 and may be deflected and guided into the compartments 406. In some embodiments, the adjacent fingers 408, 410 may include a biased element (e.g., spring 418) extending between the adjacent fingers 408, 410 for assisting in holding playing cards securely within the plurality of compartments 406 after insertion into the multi-compartment carousel 402. It is noted that in other embodiments, the multi-compartment carousel 402 may include fewer than thirty-nine (39) compartments 406 or more than thirty-nine (39) compartments 406. In some embodiments, each compartment 406 of the plurality of compartments 406 may be sized and shaped to hold between six and twenty playing cards. In some embodiments, each compartment 406 of the plurality of compartments 406 may be sized and shaped to hold between ten and sixteen playing cards. For example, each compartment 406 of the plurality of compartments 406 may be sized and shaped to hold thirteen cards.

Although, the card handling device 100 of the present disclosure is described as the card shuffling apparatus 204 including a multi-compartment carousel 402, the card shuffling apparatus 204 may include any suitable shuffling mechanism such as, for example, those disclosed in U.S. Pat. No. 5,676,372 to Sines et al. that issued Oct. 14, 1997, U.S. Pat. No. 6,254,096 to Grauzer et al. that issued Jul. 3, 2001, U.S. Pat. No. 6,651,981 to Grauzer et al. that issued Nov. 25, 2003, and U.S. Pat. No. 6,659,460 to Blaha et al. that issued Dec. 9, 2003, the disclosures of each of which are incorporated herein in their entireties by this reference. In some embodiments, the card shuffling apparatus 204 may have a wheel or carousel design that may be somewhat similar to the card-shuffling devices disclosed in the aforementioned and incorporated by reference U.S. Pat. Nos. 6,659,460 and 8,800,993 B2.

In some embodiments, the card shuffling apparatus 204 may operate, in at least one operational mode, as a continuous shuffling machine. In other words, the card shuffling apparatus 204 may be configured to continuously receive cards (e.g., after each round of play) and may continuously shuffle cards and provide cards to the dealer without unloading unused cards. In contrast, batch shuffling the one or more decks of cards involves unloading the entire set of cards after each shuffling cycle. For example, the card shuffling apparatus 204 may shuffle the playing cards such that playing cards discarded and reinserted into the card handling device 100 from a previous round have a chance of appearing (e.g., being dealt) in the next round.

In some embodiments, the card shuffling apparatus 204 may operate, in at least one operational mode as a batch shuffling machine. For example, the card shuffling apparatus 204 may be configured to shuffle a complete set or "shoe" of one or more decks of cards (e.g., one, two, four, six, eight decks of cards, etc.) and then provide the cards from those decks to the dealer (e.g., one card at a time) until the set of cards is depleted, or a cut card is reached.

Figure 4B:
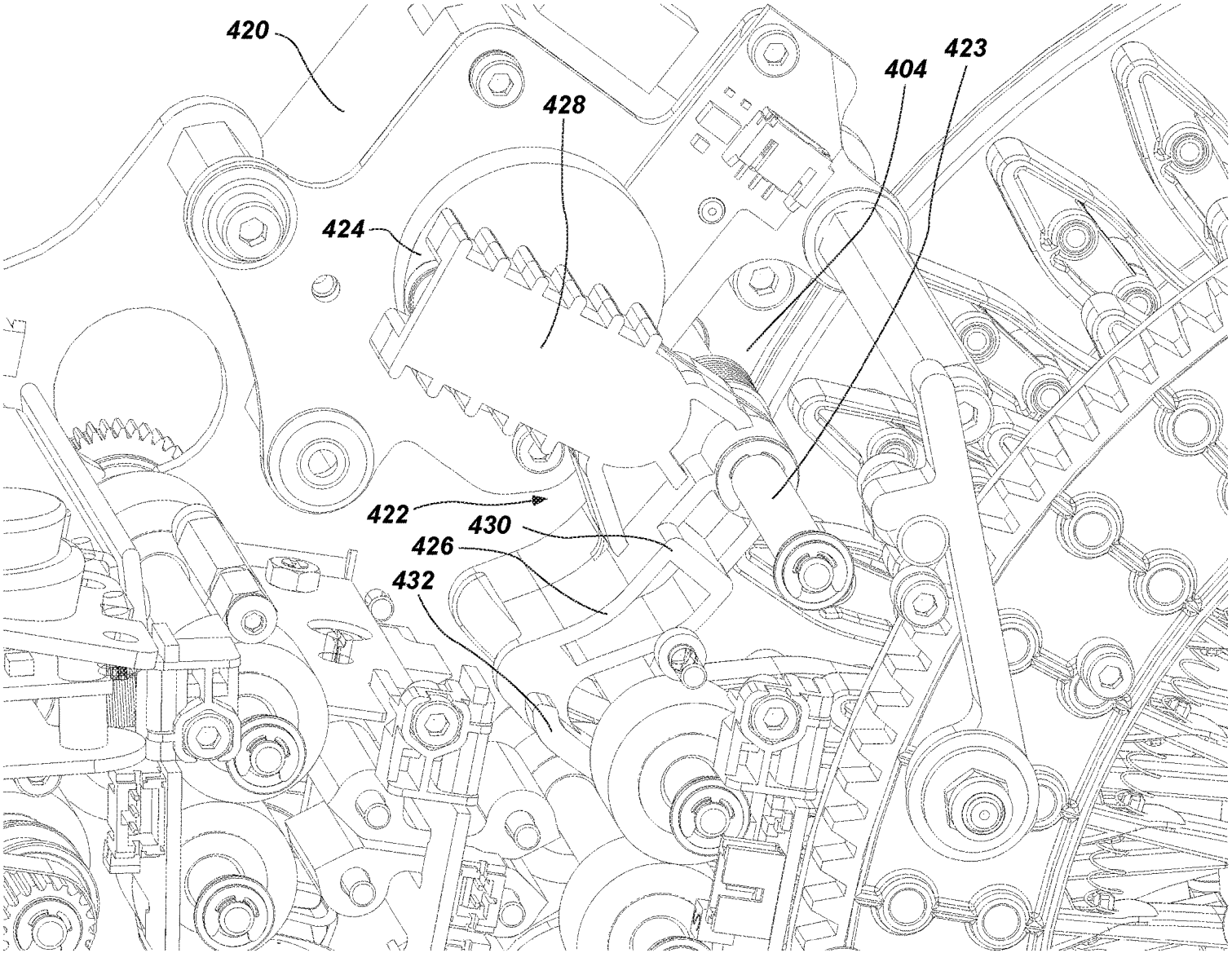
FIG. 4B shows an enlarged perspective view of a packer arm portion of the card shuffling apparatus of the card handling device of FIG. 4A.

FIG. 4B is an enlarged perspective view of the packer arm device 404 of the card shuffling apparatus 204 of FIG. 4A. Referring to FIGS. 4A and 4B together, the packer arm device 404 of the card shuffling apparatus 204 may assist in inserting playing cards into each compartment 406 of the plurality of compartments 406 of the multi-compartment carousel 402. The packer arm device 404 may include a motor 420, an elongated packer arm 422, a packer arm shaft 423, and an eccentric cam member 424. The elongated packer arm 422 may include a pusher portion 426 and a pivot arm portion 428. The pusher portion 426 of the elongated packer arm 422 may have a generally L-shape having a first leg 430 and a second leg 432. The second leg 432 may extend from a first end of the first leg 430 in a direction at least generally perpendicular to a direction in which the first leg 430 extends. The pivot arm portion 428 of the elongated packer arm 422 may extend from a second end of the first leg 430 in a direction at least substantially opposite to the direction in which the second leg 432 of the pusher portion 426 of the elongated packer arm 422 extends. The second end of the first leg 430 may be rotatably coupled to the packer arm shaft 423, which may be connected to the frame structure 102 of the card handling device 100. The pivot arm portion 428 of the elongated packer arm 422 may be coupled to the eccentric cam member 424.

The elongated packer arm 422 may rotate about the packer arm shaft 423 and the second leg 432 of the pusher portion 426 of the elongated packer arm 422 may translate partially along the first card pathway 312 of the first card feed system 306 (FIG. 3) to ensure proper loading of the playing cards within the plurality of compartments 406 of the multi-compartment carousel 402. The motor 420 may rotate the eccentric cam member 424, which may, in turn, cause the elongated packer arm 422 of the packer arm device 404 to rock back and forth along an arc-shaped path.

In some embodiments, the packer arm device 404 may be used to provide additional force to a playing card along the first card pathway 312 as the playing card leaves the pair of rollers 320*a*, 320*b*. For example, the packer arm device 404 may be located in the card handling device 100 such that a portion of the second leg 432 of the elongated packer arm 422 of the packer arm device 404 may abut against a trailing edge of a playing card and force the playing card at least substantially completely into a compartment 406 of the plurality of compartments 406 of the card shuffling apparatus 204. In some embodiments, the packer arm device 404 may be similar to the devices disclosed in the aforementioned and incorporated by reference U.S. Pat. Nos. 6,659,460, 7,766,332, and 8,800,993 B2.

Figure 5A:
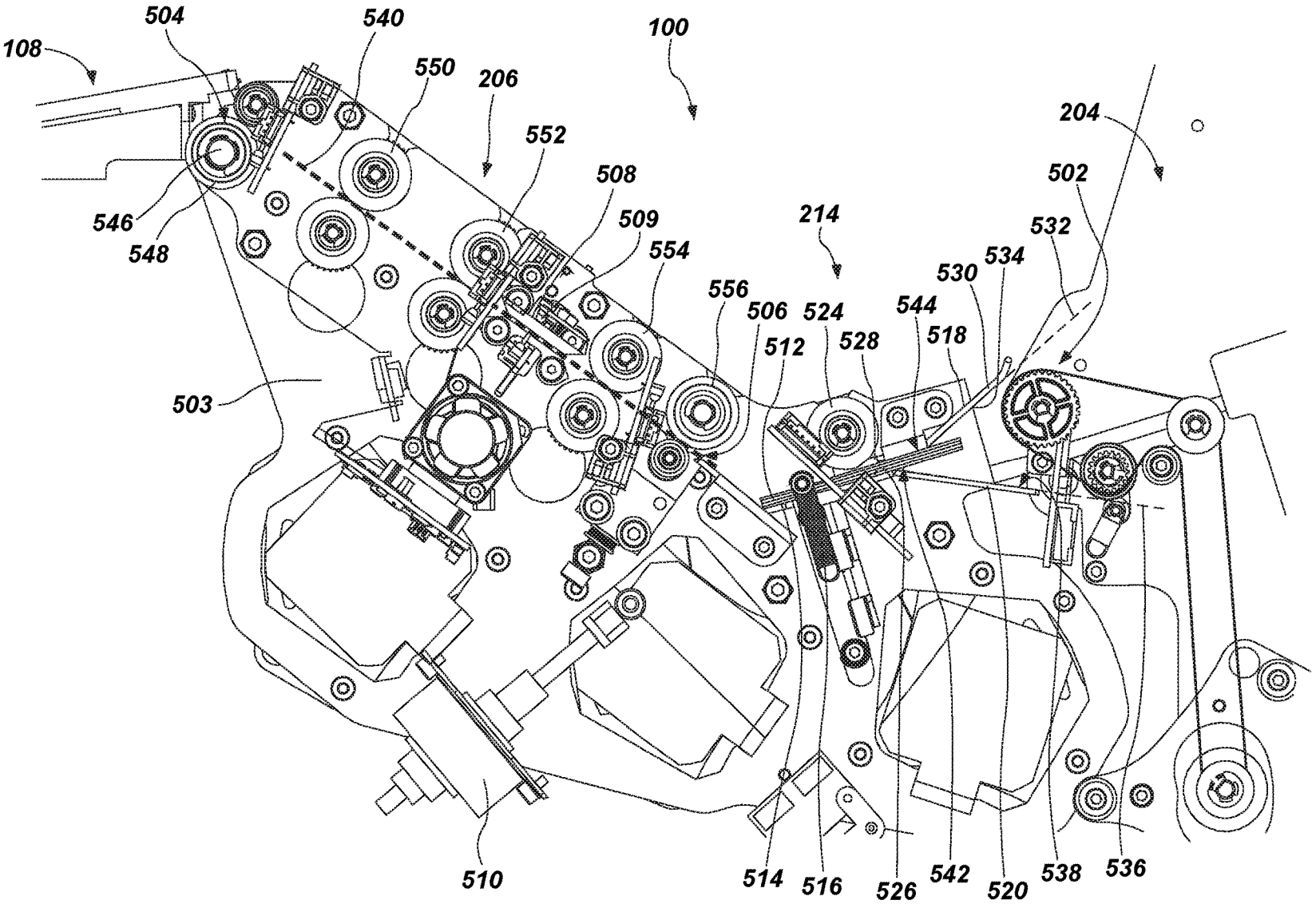
FIG. 5A shows an enlarged side view of a card output portion of the card handling device of FIG. 1 in a first orientation.
Figure 5B:
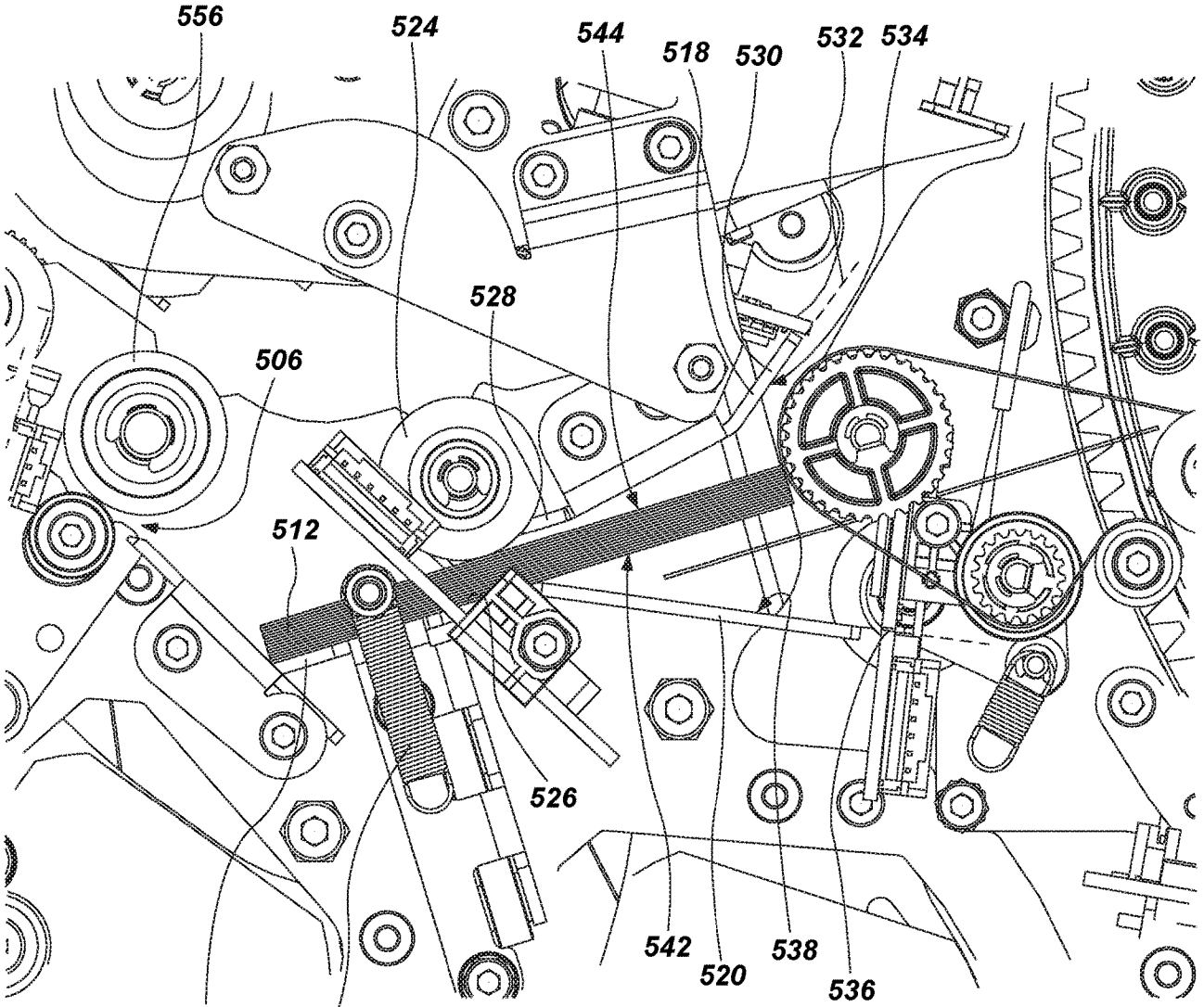
FIG. 5B shows an enlarged side view of a card output portion in the first orientation.
Figure 5C:
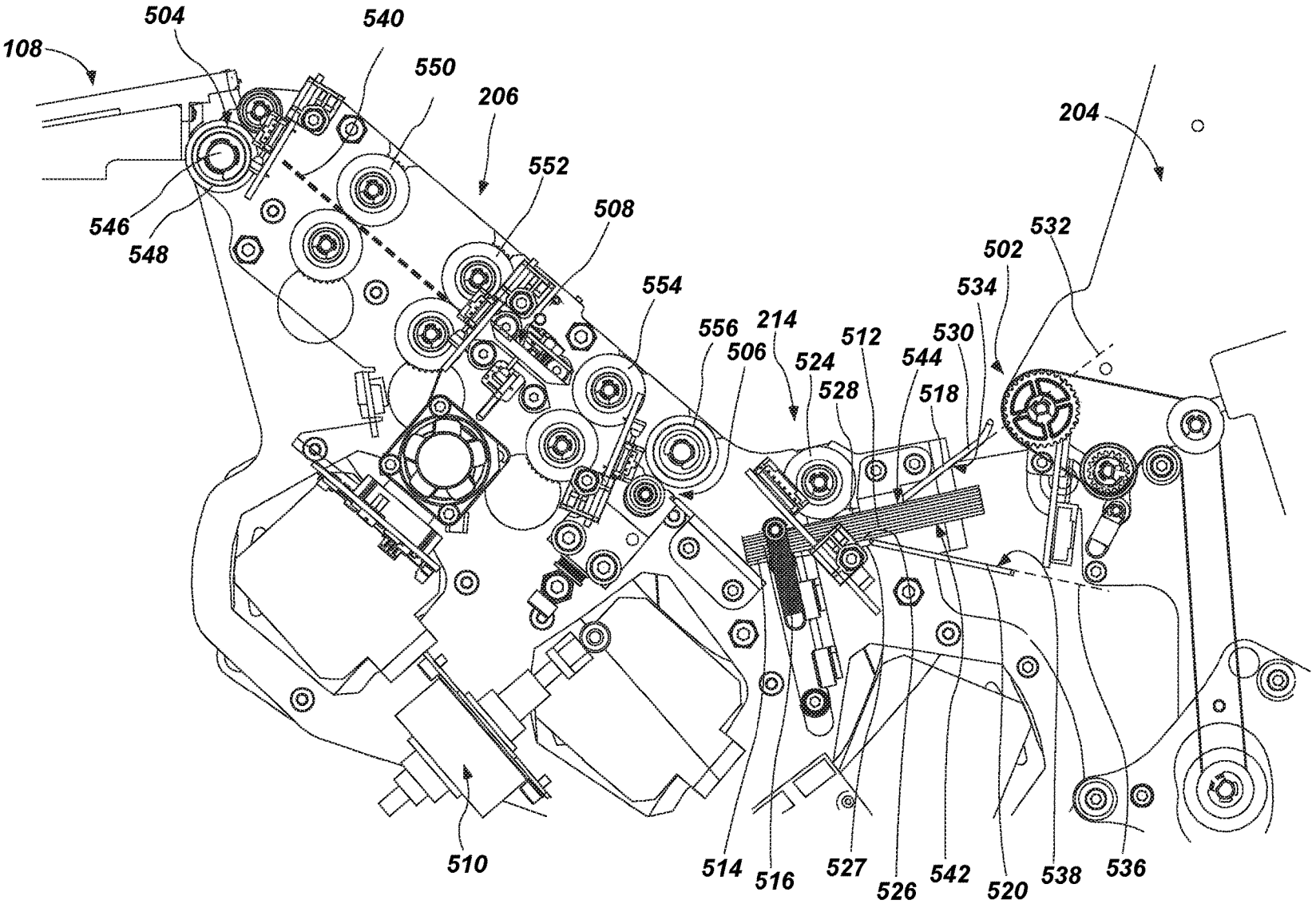
FIG. 5C shows an enlarged side view of the card output portion of FIG. 5A in a second orientation.
Figure 5D:
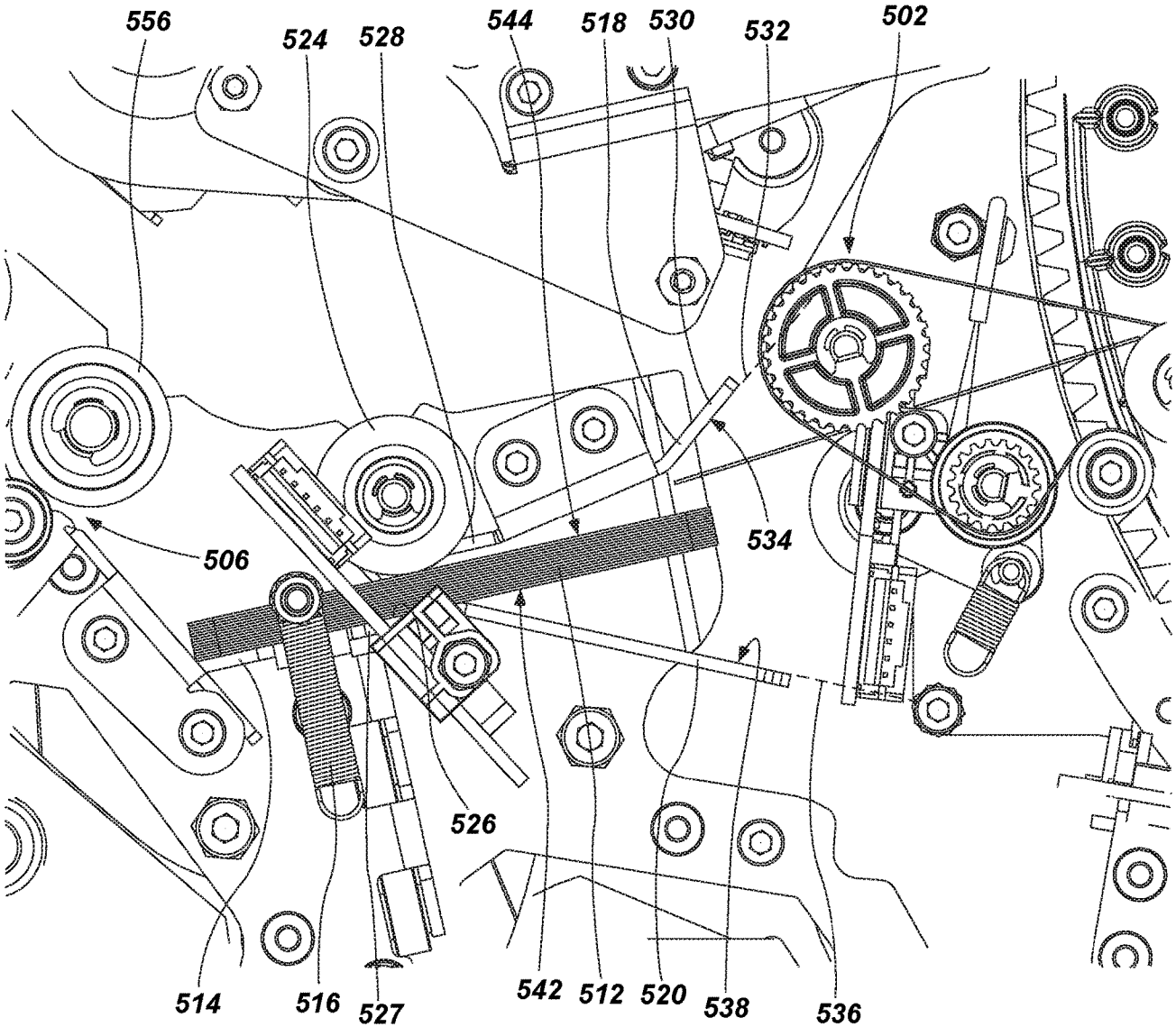
FIG. 5D shows an enlarged side view of a card output portion in the second orientation.
Figure 5E:
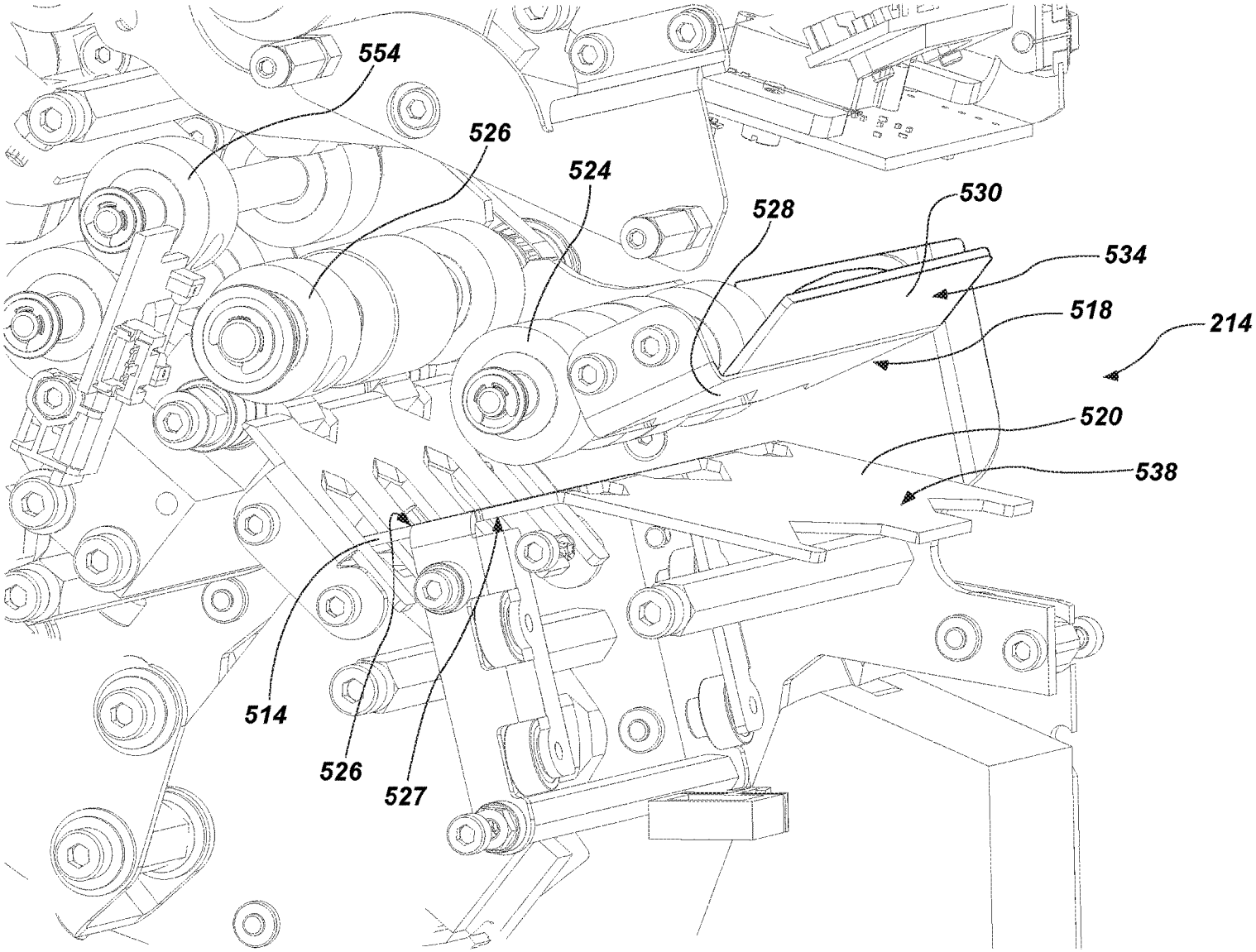
FIG. 5E shows an enlarged perspective view of a card buffer area of the card output portion of FIGS. 5A-5D.

A side view of the card output portion 206 of the card handling device 100 of FIG. 1 in a first orientation is shown in FIG. 5A. An enlarged side view of the card output portion 206 in the first orientation is shown in FIG. 5B. A side view of the card output portion 206 of the card handling device 100 of FIG. 1 in a second orientation is shown in FIG. 5C. An enlarged side view of the card output portion 206 in the second orientation is shown in FIG. 5D. An enlarged perspective view of the card buffer area 214 of the card output portion 206 of the card handling device 100 of FIG. 1 is shown in FIG. 5E. Referring to FIGS. 5A-5E together, the card shuffling apparatus 204 may further include a card transfer system 502, and the card output portion 206 may include the card buffer area 214, a second frame assembly 503, a second pivoting axis 504, a second card feed system 506, a second card imaging system 508, and an actuation system 510.

Referring to FIGS. 4A and 5A-5E together, the card transfer system 502 of the card shuffling apparatus 204 may transfer playing cards from the plurality of compartments 406 of the multi-compartment carousel 402 to the card buffer area 214 of the card output portion 206 of the card handling device 100. In some embodiments, the card transfer system 502 may be configured to unload the plurality of compartments 406 in a compartment 406 by compartment 406 manner. For example, the card transfer system 502 may unload a first compartment 406 completely before unloading a second compartment 406. In some embodiments, the second compartment 406 may be a compartment 406 adjacent to the first compartment 406. In other embodiments, the second compartment 406 may be a randomly selected compartment 406 and may not necessarily be a compartment 406 adjacent to the first compartment 406. In some embodiments, the card transfer system 502 may not unload the plurality of compartments 406 compartment 406 by compartment 406 but, rather, may unload playing cards from the plurality of compartments 406 in a randomized (e.g., non-sequential) order. For example, the card transfer system 502 may unload one or more playing cards from a first compartment 406 without unloading other playing cards in the first compartment 406 and then may unload one or more playing cards from a second compartment 406 (e.g., with or without unloading other playing cards in the second compartment 406). In some embodiments, the card transfer system 502 may unload the playing cards one-at-a-time. In other embodiments, the card transfer system 502 may unload multiple playing cards at a time.

Referring to FIGS. 5A-5E, as discussed above, the card buffer area 214 of the card output portion 206 may be positioned at the interface 216 (FIG. 2) of the card shuffling apparatus 204 and the card output portion 206 of the card handling device 100. In some embodiments, the card buffer area 214 may be positioned within the card handling device 100 such that the card buffer area 214 is inaccessible to a dealer. The card buffer area 214 of the card output portion 206 may receive playing cards from the card shuffling apparatus 204 and may be able to hold a group of playing cards 512 temporarily prior to the playing cards being transferred to the substantially flat card output area 108. As discussed in further detail below, the card buffer area 214 may maintain a group of playing cards 512 having a number of playing cards within the range of nine to twenty-one.

The card buffer area 214 of the card output portion 206 may include a plate 514 (e.g., support), a spring 516 (e.g., a bias), a first card guide 518, a second card guide 520, and a buffer pick-off roller 524. The plate 514 may include an upper surface 526 for supporting a group of playing cards 512 and an opposite bottom surface 527. The spring 516 may be attached to the bottom surface 527 of the plate 514, and a combination of the plate 514 and spring 516 may form a spring-loaded plate. For example, the spring 516 may push the plate 514 toward the buffer pick-off roller 524 and/or press the plate 514 against the group of playing cards 512. The buffer pick-off roller 524 may be oriented above the plate 514, and the card buffer area 214 may hold the group of playing cards 512 between the upper surface 526 of the plate 514 and the buffer pick-off roller 524. The first card guide 518 may be oriented above the plate 514 and proximate the buffer pick-off roller 524. The first card guide 518 may include a first portion 528 and a second portion 530. The first portion 528 of the first card guide 518 may extend from the buffer pick-off roller 524 in a direction toward the card shuffling apparatus 204, tangential to an outer circumference of the buffer pick-off roller 524, and parallel to the upper surface 526 of the plate 514 of the card buffer area 214. The second portion 530 of the first card guide 518 may extend upwards from the first portion 528 of the first card guide 518 (e.g., in a direction away from the card buffer area 214) from a side of the first portion 528 facing the card shuffling apparatus 204. The second portion 530 of the first card guide 518 may extend in a first plane 532 that is oriented at an acute angle relative to the upper surface 526 of the plate 514 of the card buffer area 214. The second portion 530 of the first card guide 518 may also form a first beveled edge 534 that leads to an area between the plate 514 and the buffer pick-off roller 524 and enables and guides insertion of playing cards on the top 544 of the group of playing cards 512 already present in the card buffer area 214. The second card guide 520 may be part of the plate 514 and extend downward from the plate 514 (e.g., in a direction away from the card buffer area 214) on a side of the plate 514 facing the card shuffling apparatus 204. The second card guide 520 may extend in a second plane 536 that is oriented at an acute angle relative to the upper surface 526 of the plate 514. The second card guide 520 may form a second beveled edge 538 that leads to an area between the plate 514 and buffer pick-off roller 524 and enables and guides insertion of playing cards at the bottom 542 of (e.g., beneath) the group of playing cards 512 already present in the card buffer area 214. Put another way, the first card guide 518 and second card guide 520 may extend, diverge, and/or fan outward from the space between the plate 514 and buffer pick-off roller 524 and may guide playing cards transferred by the card transfer system 502 from the multi-compartment carousel 402 into the space between the plate 514 and buffer pick-off roller 524.

The card buffer area 214 may adjust in size to accommodate different amounts of playing cards. For example, as discussed above, the plate 514 of the card buffer area 214 may be spring-loaded. As a result, the plate 514 may be able to translate generally up and down vertically relative to the card transfer system 502 of the card shuffling apparatus 204. Furthermore, the plate 514 may be able to translate relative to the buffer pick-off roller 524 such that the space between the plate 514 and the buffer pick-off roller 524 expands or contracts as the plate 514 translates. The volume of the card buffer area 214 may expand or contract responsive to playing cards being inserted into the card buffer area 214 by the card transfer system 502 or playing cards being removed from the card buffer area 214 by the buffer pick-off roller 524.

In some embodiments, the card buffer area 214 of the card output portion 206 may maintain a minimum number of playing cards in the card buffer area 214. For example, the card buffer area 214 of the card output portion 206 may maintain five to seven playing cards in the card buffer area 214. In some embodiments, the card buffer area 214 of the card output portion 206 may maintain seven to nine cards in the card buffer area 214. In some embodiments, the card buffer area 214 of the card output portion 206 may maintain more than nine cards in the card buffer area 214. For example, the card buffer area 214 of the card output portion 206 may maintain nine cards in the card buffer area 214. In some embodiments, the card buffer area 214 of the card output portion 206 may have a maximum number of playing cards that fit in the card buffer area 214 of the card output portion 206. For example, the maximum number of playing cards that fit in the card buffer area 214 may be within a range of ten to fifteen playing cards. In other embodiments, the maximum number of playing cards that fit in the card buffer area 214 may be within a range of fifteen to twenty playing cards. In other embodiments, the maximum number of playing cards that fit in the card buffer area 214 may be within a range of twenty to twenty-five playing cards. In some embodiments, the maximum number of playing cards that fit in the card buffer area 214 may be twenty-two playing cards.

Referring to FIGS. 1 and 5A-5E together, in some embodiments, the control system 105 may maintain a count of a number of playing cards that are present in the card buffer area 214. For example, the control system 105 may track how many playing cards are inserted into the card buffer area 214 by the cards transfer system 502, and the control system 105 may track how many playing cards are removed from the card buffer area 214 by the second card feed system 506. By tracking movement of playing cards into and out of the card buffer area 214, the control system 105 may determine when the card buffer area 214 contains a minimum number of playing cards in the card buffer area 214. Furthermore, the control system 105 may determine when the card buffer area 214 contains a maximum number of cards in the card buffer area 214. Upon determination that the card buffer area 214 contains the minimum number of cards in the card buffer area 214, the control system 105 may add playing cards to the card buffer area 214 by having the card transfer system 502 insert additional playing cards into the card buffer area 214. Upon determination that the card buffer area 214 contains the maximum number of cards in the card buffer area 214, the control system 105 may temporarily stop the card transfer system 502 from adding playing cards to the card buffer area 214. The function and operation of the control system 105 are described in further detail in regard to FIG. 10.

In some embodiments, the card output portion 206 may have at least a first orientation and a second orientation relative to card shuffling apparatus 204 of the card handling device 100, as shown in FIGS. 5A-5E, respectively. Referring to FIGS. 5A and 5B, while the card output portion 206 is in the first orientation, the card transfer system 502 of the card shuffling apparatus 204 may insert playing cards into the card buffer area 214 of the card output portion 206 at a bottom 542 of (e.g., beneath) the group of playing cards 512 already present in the card buffer area 214. For example, the card transfer system 502 may remove one or more playing cards from one of the plurality of compartments 406 (FIG. 4A) of the multi-compartment carousel 402 (FIG. 4A) and may insert the playing card into the card buffer area 214 by sliding the playing card against the second beveled edge 538 of the second card guide 520 and the upper surface 526 of the plate 514 until the playing card is between the plate 514 and buffer pick-off roller 524 of the card buffer area 214. In other words, the card transfer system 502 may remove a playing card from one of the plurality of compartments 406 (FIG. 4A) of the multi-compartment carousel 402 (FIG. 4A) and may slide a leading edge of the playing card against the second beveled edge 538 of the second card guide 520 until the playing card presses up against a bottom surface of a bottommost card of the group of playing cards 512. The card transfer system 502 may continue to slide the playing card between the bottom surface of a bottommost card of the group of playing cards 512 and the upper surface of the plate 514 until the playing card is at least substantially aligned (e.g., nested) with the other playing cards in the group of playing cards 512. Such an operation may result in inserting the playing card at the bottom 542 of the group of playing cards 512. Furthermore, while in the first orientation, the buffer pick-off roller 524 of the second card feed system 506 may remove playing cards from a top 544 of the group of playing cards 512 in the card buffer area 214 and the group of playing cards 512 may be transported to the substantially flat card output area 108 of the card handling device 100 in a same order in which the playing cards were inserted into the card buffer area 214 by the card transfer system 502.

Referring to FIGS. 5C and 5D, while the card output portion 206 is in the second orientation, the card transfer system 502 may insert playing cards into the card buffer area 214 of the card output portion 206 at a top 544 of the group of playing cards 512 already present in the card buffer area 214. For example, the card transfer system 502 may remove one or more playing cards from one of the plurality of compartments 406 (FIG. 4A) of the multi-compartment carousel 402 (FIG. 4A) and may insert the playing card into the card buffer area 214 by sliding the playing card against the first beveled edge 534 of the second portion 530 of the first card guide 518 and the first portion 528 of the first card guide 518 until the playing card is between the plate 514 and buffer pick-off roller 524 of the card buffer area 214. In other words, the card transfer system 502 may remove a playing card from one of the plurality of compartments 406 (FIG. 4A) of the multi-compartment carousel 402 (FIG. 4A) and may slide a leading edge of the playing card against the first beveled edge 534 of the second portion 530 of the first card guide 518 until the playing card presses up against a top surface of an uppermost card of the group of playing cards 512. The card transfer system 502 may continue to slide the playing card between the top surface of an uppermost card of the group of playing cards 512 and the first portion 528 of the first card guide 518 until the playing card is at least substantially aligned (e.g., nested) with the other playing cards in the group of playing cards 512. Such an operation may result in positioning the playing card at the top 544 of the group of playing cards 512. As a result, any playing cards inserted into the card buffer area 214 at the top 544 of the group of playing cards 512 already in the card buffer area 214 may be removed by the buffer pick-off roller 524 of the second card feed system 506 prior to playing cards that were already in the card buffer area 214. Accordingly, while in the second orientation, the card buffer area 214 of the card handling device 100 may be able to perform an overtake function where a playing card withdrawn from the multi-compartment carousel 402 (FIG. 4A) may pass up (e.g., overtake or pre-empt) the group of playing cards 512 that is already in the card buffer area 214. In some embodiments, only one playing card at a time will pass up the group of playing cards 512 already in the card buffer area 214. In other embodiments, multiple playing cards at a time will pre-empt the group of playing cards 512 already in the card buffer area 214.

In some embodiments, the card output portion 206 may be configured to move between the first orientation and the second orientation in an at least substantially random or automatic (e.g., without human intervention) manner. For example, the card output portion 206 may be fully controlled by the control system 105 (FIG. 1) such that a dealer administering the card handling device 100 at a table 212 (FIG. 2) and/or any players playing at the table 212 (FIG. 2) are unaware of the movement of the card output portion 206 and the placement order of the cards in the card buffer area 214. In some embodiments, the control system 105 may include a random number generator and may determine when to move the card output portion 206 between the first orientation and the second orientation based on the numbers generated by the random number generator. In some embodiments, a default position of the card output portion 206 may be in the first orientation. For example, the card output portion 206 may be typically oriented in the first orientation and may just move into the second orientation temporarily as determined by the control system 105.

Referring to FIGS. 1 and 5A-5E together, in some embodiments, the card output portion 206 may be moved back and forth between the first orientation and second orientation by the actuation system 510 of the card output portion 206. The actuation system 510 may be mounted at one end to the frame structure 102 of the card handling device 100 and at another end to the second frame assembly 503 of the card output portion 206 and may be able to extend and contract. Furthermore, the actuation system 510 may be controlled by the control system 105 of the card handling device 100. When the actuation system 510 extends or retracts, the actuation system 510 may move at least substantially the entire card output portion 206 of the card handling device 100 relative to the card shuffling apparatus 204 of the card handling device 100. In some embodiments, the actuation system 510 may move the card output portion 206 such that the card buffer area 214 of the card output portion 206 moves at least partially in a vertical direction relative to the card transfer system 502 of the card shuffling apparatus 204. As a result, when the actuation system 510 moves the card buffer area 214 of the card output portion 206 back and forth vertically, the card transfer system 502 of the card shuffling apparatus 204 may be able to insert playing cards from the card shuffling apparatus 204 at both the top 544 and bottom 542 of the group of playing cards 512 in the card buffer area 214. In some embodiments, the actuation system 510 may include one or more of an electronic piston, electronic solenoid, and motor spindle. In other embodiments, the actuation system 510 may be pneumatically operated.

In some embodiments, the card output portion 206 may be rotatable about the second pivoting axis 504 relative to the card shuffling apparatus 204 of the card handling device 100. For example, the second pivoting axis 504 may include a second shaft 546 rotatably mounted at both ends to the frame structure 102 of the card handling device 100. The second shaft 546 of the second pivoting axis 504 may extend axially in a direction substantially parallel to a table surface 210 (FIG. 2) of a table 212 (FIG. 2) to which the card handling device 100 may be mounted. In some embodiments, the second pivoting axis 504 of the card output portion 206 may be oriented proximate the substantially flat card output area 108 of the card handling device 100. When the actuation system 510 moves the card output portion 206, the card output portion 206 may rotate about the second pivoting axis 504 and the card buffer area 214 of the card output portion 206 may move at least partially in a vertical direction relative to the card shuffling apparatus 204, which, as a result, allows the card transfer system 502 to insert playing cards at the top 544 and bottom 542 of the group of playing cards 512 in the card buffer area 214. As described above, allowing the card transfer system 502 to insert playing cards at the top 544 of the group of playing cards 512 in the card buffer area 214 enables playing cards to overtake the group of playing cards 512 in the card buffer area 214 as part of a playing card bypass process.

Having playing cards overtake the group of playing cards 512 in the card buffer area 214 may assist in the prevention of counting cards by players. For example, several methods of counting cards rely on knowing what rankings of playing cards in a group of playing cards 512 (e.g., in a selected number of decks) remain to be dealt, have been dealt, and/or remain in the shoe before the deck or decks of cards are reshuffled as a batch or recycled through a continuous shuffler. As mentioned above, the card shuffling apparatus 204 of the card handling device 100 may be a continuous shuffling apparatus and may operate to at least partially shuffle used playing cards back into the plurality of compartments 406 of the multi-compartment carousel 402 and the card buffer area 214 of the card output portion 206 without unloading all of the cards at the end of a round of play. Furthermore, by having a playing card overtake (e.g., bypass) the group of playing cards 512 in the card buffer area 214, a playing card used in a previous hand has a chance of being dealt at least almost immediately after reinsertion into the card handling device 100. As a result, it may be more difficult for a player to know what playing cards to expect or not to expect in a next hand. When using a card handling device that holds a group of cards in a buffer area and does not have playing cards overtake other playing cards in the shoe or card shuffling apparatus, a player can expect playing cards from a previous hand to not be dealt for at least a certain number of playing cards (e.g., a minimum number of playing cards in a card buffer area 214 or playing cards already collected in a shoe). However, a player playing at a table 212 (FIG. 2) using the card handling device 100 of the present disclosure cannot assume that playing cards of the previous hand will not be dealt for a certain number of playing cards. In fact, having a playing card randomly overtake the group of playing cards 512 in the card buffer area 214 may make it nearly impossible for a player to effectively count cards using known methods. Accordingly, having playing cards overtake the group of playing cards 512 in the card buffer area 214 further randomizes the order of the playing cards that are dealt from the substantially flat card output area 108 and may help to maintain a house advantage in card games where card counting is a frequent problem.

Referring again to FIGS. 5A-5E, the second card feed system 506 of the card output portion 206 may include a second card pathway 540 (e.g., pathway along which playing cards move through the card output portion 206). The second card pathway 540 may lead from the card buffer area 214 of the card handling device 100 to the substantially flat card output area 108 of the card handling device 100. The buffer pick-off roller 524 of the second card feed system 506 may remove playing cards from the card buffer area 214 from a top 544 of a group of playing cards 512 collected in the card buffer area 214 of the card output portion 206. The second card feed system 506 may further have additional pairs of rollers 548, 550, 552, 554, 556, that may displace playing cards from the card buffer area 214 to the substantially flat card output area 108 of the card handling device 100. For example, as described above, the buffer pick-off roller 524 of the second card feed system 506 may remove playing cards from the top 544 of the group of playing cards 512 in the card buffer area 214 and the additional rollers 548, 550, 552, 554, 556, may transport the playing cards to the substantially flat card output area 108. In some embodiments, the second card feed system 506 of the card output portion 206 may transport playing cards to the substantially flat card output area 108 one-at-a-time. In some embodiments, the second card feed system 506 may not transport another playing card to the substantially flat card output area 108 until a playing card present in the substantially flat card output area 108 (e.g., previously sent to the substantially flat card output area 108) is taken out of the substantially flat card output area 108 (e.g., dealt or otherwise removed by a dealer). In other words, until the control system 105 receives a signal indicating the absence of a playing card in the substantially flat card output area 108, another playing card may not be delivered to the substantially flat card output area 108.

Furthermore, because of the overtake function of the card handling device 100 and because the playing cards may be sent one-at-a-time to the substantially flat card output area 108, there may not be a collection of playing cards within the card handling device 100 that cannot be changed prior to sending a next playing card to the substantially flat card output area 108. As a result, randomization of the playing cards is further increased by the card handling device 100 of the current disclosure when compared with conventional card shufflers.

In some embodiments, the second card imaging system 508 may be oriented along the second card pathway 540 of the second card feed system 506. The second card feed system 506 may transport playing cards past the second card imaging system 508, and the second card imaging system 508 may capture identifying information of each playing card as each playing card moves along the second card pathway 540 before insertion in the substantially flat card output area 108. The second card imaging system 508 may be similar to the first card imaging system 308 and may comprise any of the components described above. For example, the second card imaging system 508 may include a second sensor 509, etc. Referring to FIGS. 3, 5A, and 5B together, as noted above, the first card imaging system 308 and the second card imaging system 508 may be used together to keep an inventory of the playing cards being sent through the card handling device 100. For example, the control system 105 (FIG. 1) may take a first inventory of the playing cards as the playing cards are inserted into the card shuffling apparatus 204, and the control system 105 (FIG. 1) may take a second inventory of the playing cards as the playing cards are inserted into substantially flat card output area 108. Furthermore, the first inventory and the second inventory may be compared and contrasted to determined behaviors of the card handling device 100, effectiveness of the card shuffling apparatus 204, and a randomness of the playing cards relative to how the playing cards entered the card shuffling apparatus 204. Moreover, the first inventory and second inventory may be used to detect tampering, cheating, or an absence of playing cards in decks handled by the card handling device 100.

Figure 6:
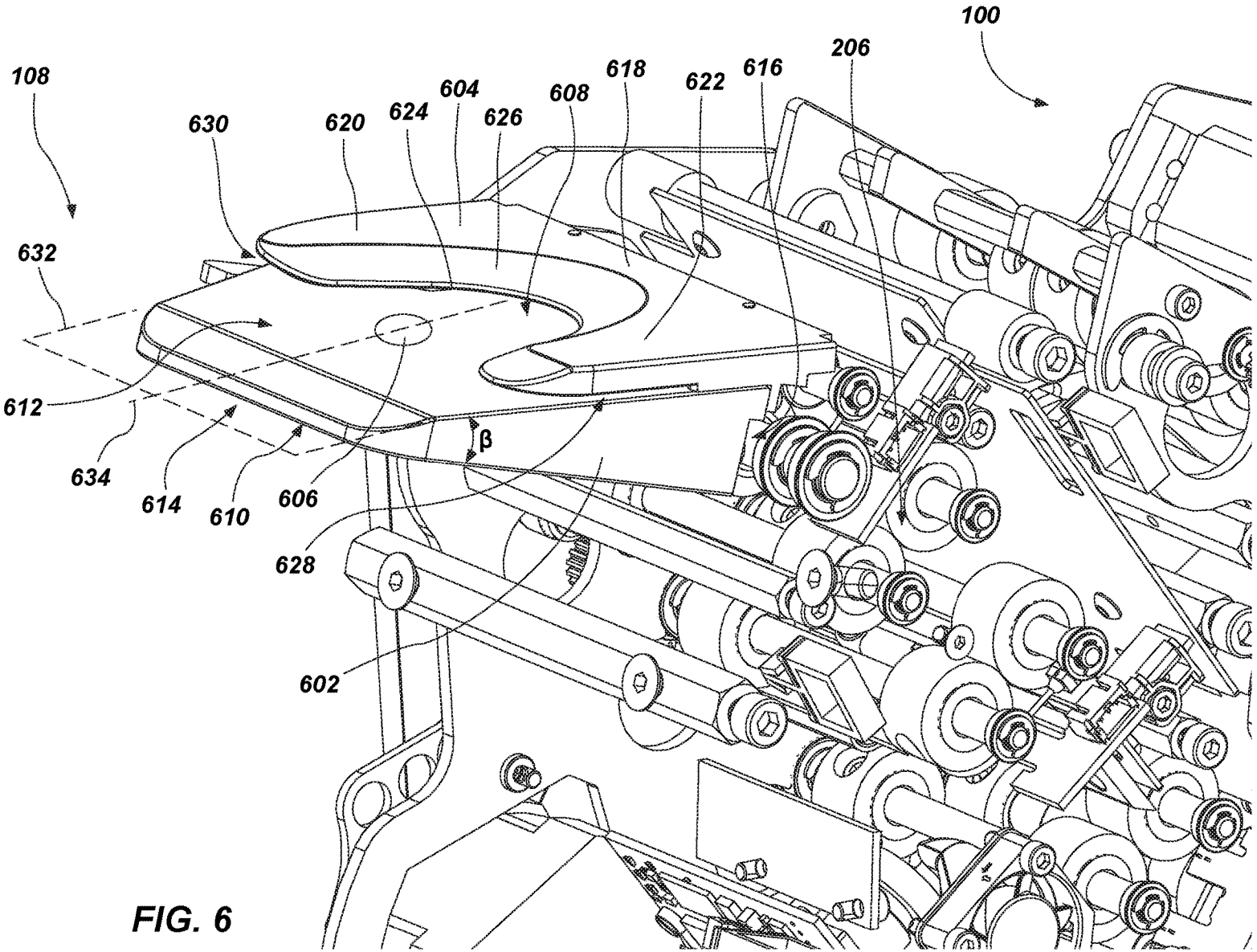
FIG. 6 shows a perspective view of a substantially flat card output area of the card handling device of FIG. 1.

FIG. 6 is a perspective view of the substantially flat card output area 108 of the card handling device 100. The substantially flat card output area 108 (e.g., substantially flat card delivery area or substantially flat card shoe) of the card handling device 100 may include an interface portion 602, a cover 604, a sensor 606, and an outlet 608. The cover 604 of the substantially flat card output area 108 may be oriented above the interface portion 602 and may cover at least a portion of the interface portion 602 of the substantially flat card output area 108. The cover 604 and the interface portion 602 of the substantially flat card output area 108 may define the outlet 608 between the cover 604 and the interface portion 602. Furthermore, the second card feed system 506 (FIG. 5A) of the card output portion 206 may be able to send playing cards one-at-a-time through the outlet 608.

The interface portion 602 of the substantially flat card output area 108 may have a lower surface 610, an opposite at least substantially flat draw surface 612, a first end 614, and a second opposite end 616. The draw surface 612 of the interface portion 602 may be able to support playing cards that are sent into the substantially flat card output area 108 from the second card feed system 506 (FIG. 5A) of the card output portion 206. The draw surface 612 of the interface portion 602 may be defined at an acute angle β relative to the lower surface 610 of the interface portion 602 (or a surface of the table surface 210 of the table 212 to which the card handling device 100 is mounted as shown in FIG. 2). In other words, the interface portion 602 of the substantially flat card output area 108 may have an at least general wedge shape. In some embodiments, the acute angle β may be within a range of 3° to 5°. In other embodiments, the acute angle β may be within a range of 5° to 10°. In other embodiments, the acute angle β may be within a range of 10° to 20°. In other embodiments, the acute angle β may be at least about 10°. The acute angle β may be selected in order to provide the dealer the greatest amount of comfort while manually removing cards. The second end 616 of the interface portion 602 of the substantially flat card output area 108 may be attached to or may be proximate to the card output portion 206 of the card handling device 100. The first end 614 of the interface portion 602 of the substantially flat card output area 108 may be oriented distal to the card output portion 206 of the card handling device 100.

When the card handling device 100 is mounted to a table 212 (FIG. 2), the lower surface 610 of the interface portion 602 of the substantially flat card output area 108 may rest on a table surface 210 (FIG. 2) of the table 212 (FIG. 2), and the draw surface 612 of the interface portion 602 of the may be oriented at the acute angle β relative to the table surface 210 (FIG. 2). Having the draw surface 612 of the interface portion 602 oriented at a relatively small acute angle β relative to the surface of the table 212 (FIG. 2) may decrease an extent to which dealers are required to twist their wrists and lift their hands when drawing playing cards from the substantially flat card output area 108 when compared to conventional card shoes. As a result, the substantially flat card output area 108 may increase a speed at which a dealer may deal playing cards to players, which, in turn, may increase a pace at which games may be administered at a table 212 (FIG. 2). Furthermore, the substantially flat card output area 108 may, over time, decrease fatigue that dealers may experience in their wrists and/or hands when administering a game at a table 212 (FIG. 2).

The cover 604 of the substantially flat card output area 108 may have a base portion 618 and two laterally spaced arm portions 620, 622 extending from the base portion 618. The base portion 618 of the cover 604 may be oriented proximate the second end 616 of the interface portion 602 of the substantially flat card output area 108 and may extend above the second end 616 of the interface portion 602 of the substantially flat card output area 108. The two arm portions 620, 622 of the cover 604 may extend from the base portion 618 of the cover 604 toward the first end 614 of the interface portion 602 of the substantially flat card output area 108. The two arm portions 620, 622 of the cover 604 may be separated from each other by a cutout 624 extending vertically though the cover 604. For example, the cover 604 may have an at least general U-shape when viewed from a top of the cover 604 of the substantially flat card output area 108, wherein the base portion 618 forms the bottom part of the U and the two arm portions 620, 622 form the two extending arms of the U. In some embodiments, the cutout 624 in the cover 604 may have a semicircular shape. In other embodiments, the cutout 624 in the cover 604 may have a rectangular shape. The cutout 624 may serve to expose portions of the playing cards that are sent to the substantially flat card output area 108 and may make the playing cards more accessible to dealers. In some embodiments, an interface of the cutout 624 of the cover 604 with the base portion 618 and two arm portions 620, 622 of the cover 604 may define a chamfered edge 626, which may make it more comfortable for a dealer to draw a playing card from the substantially flat card output area 108.

In some embodiments, each arm portion 620, 622 of the two arm portions 620, 622 of the cover 604 of the substantially flat card output area 108 may be at least partially separated from the draw surface 612 of the interface portion 602 of the substantially flat card output area 108 by an opening 628, 630. In other words, the two arm portions 620, 622 may extend from the base portion 618 of the cover 604 and may overhang at least a portion of the interface portion 602 of the substantially flat card output area 108 in a cantilevered manner. The openings 628, 630 separating each arm portion 620, 622 of the two arm portions 620, 622 of the cover 604 from the draw surface 612 of the interface portion 602 may allow playing cards to pass under the two arm portions 620, 622 and through the openings 628, 630. In other words, As a result, the openings 628, 630 may permit playing cards that are sent into the substantially flat card output area 108 by the second card feed system 506 (FIG. 5A) to be drawn from the outlet 608 of the substantially flat card output area 108 in multiple, different, at least substantially horizontal directions. A range of directions comprising an included angle in which playing cards may be drawn from the outlet 608 of substantially flat card output area 108 may be characterized as a "drawable angle." For example, playing cards may be drawn from the outlet 608 of the substantially flat card output area 108 in any direction extending within the drawable angle. The drawable angle may be within a third plane 632 extending along the draw surface 612 of the interface portion 602 of the substantially flat card output area 108 and may be centered with respect to a center longitudinal axis 634 of the substantially flat card output area 108 such that half of the drawable angle extends to each side of the center longitudinal axis 634. In some embodiments, the drawable angle may be at least 60°. In other words, a first direction in which a playing card may be drawn in the drawable angle may be offset at least 60° in the third plane 632, which may contain a majority of the draw surface 612, from a second direction in which a playing card may be drawn in the drawable angle. In some embodiments, the drawable angle may be at least 90°. In some embodiments, the drawable angle may be at least 135°. In some embodiments, the drawable angle may be 180° or greater. As a result, playing cards may be drawn from the outlet 608 of the substantially flat card output area 108 in a plurality of directions including directions that are perpendicular to or even are oriented at obtuse angles relation to each other.

Stated another way, the openings 628, 630 may permit playing cards that are sent to the substantially flat card output area 108 by the second card feed system 506 (FIG. 5A) to be drawn from the outlet 608 of the substantially flat card output area 108 in multiple at least substantially horizontal directions without first being drawn in a direction collinear to the second card pathway 540 (FIG. 5A) of the card output portion 206 or parallel to the center longitudinal axis 634 of the substantially flat card output area 108. In other words, once a playing card comes to rest in the substantially flat card output area 108 after being sent to the substantially flat card output area 108 by the second card pathway 540 (FIG. 5A) of the card output portion 206, any initial draw movement made by a dealer to draw the playing card from the outlet 608 of the substantially flat card output area 108 may be in in any direction extending within the drawable angle.

Furthermore, in some embodiments, the draw surface 612 of the interface portion 602 of the substantially flat card output area 108 may not include ridges or walls obstructing the openings 628, 630. Put another way, the draw surface 612 of the interface portion 602 may be continuously planar and may extend under the two arm portions 620, 622 and completely through the openings 628, 630. Thus, playing cards may not have to pass over any ridges or walls when passing through the openings 628, 630 and being drawn from the draw surface 612 of the interface portion 602 of the substantially flat card output area 108.

Having a substantially flat card output area 108 that allows dealers to draw playing cards from the outlet 608 of the substantially flat card output area 108 within a range of directions may be advantageous over other shoes because the substantially flat card output area 108 may reduce a need to rearrange an orientation of the shoe of a card handling device 100 to meet a dealer's card drawing preference or physical limitation. Furthermore, the substantially flat card output area 108 may reduce a need to exchange shoes of a card handling device that is mounted to a table 212 (FIG. 2) in order to accommodate a dealer's card drawing preference. Moreover, the substantially flat card output area 108 may increase positions at which the dealer may comfortably be situated at a table 212 (FIG. 2) while administering a game at a table 212 (FIG. 2). Thus, the substantially flat card output area 108 may enable a more universal card shoe that does not require adjustments as dealers change at a given table 212 (FIG. 2). Additionally, the substantially flat card output area 108 may increase an efficiency of the dealer and may decrease down time at a table 212 (FIG. 2), such as, time needed to change out or adjust a shoe, which may, in turn, increase profitability at a table 212 (FIG. 2).

The sensor 606 of the substantially flat card output area 108 may be oriented in the interface portion 602 of the substantially flat card output area 108 and may be in communication with the control system 105 (FIG. 1). The sensor 606 may sense when a playing card is present or absent from the substantially flat card output area 108. In some embodiments, the sensor 606 may sense the movement of a playing card across the draw surface 612 of the interface portion 602 of the substantially flat card output area 108. In other embodiments, the sensor 606 may sense the presence or absence of a playing card. For example, the sensor 606 may include an infrared sensor. In some embodiments, during operation, when the sensor 606 of the substantially flat card output area 108 senses an absence of a playing card in the substantially flat card output area 108 or the act of a dealer drawing the playing card from the substantially flat card output area 108, the control system 105 (FIG. 1) may direct the second card feed system 506 (FIG. 5A) of the card output portion 206 to remove a playing card from the card buffer area 214 (FIG. 5A) of the card output portion 206 and to send the playing card into the substantially flat card output area 108. In some embodiments, during operation, when the sensor 606 of the substantially flat card output area 108 senses the presence of a playing card in the substantially flat card output area 108, the control system 105 (FIG. 1) may direct the second card feed system 506 of the card output portion 206 to stop sending playing cards to the substantially flat card output area 108. For example, as described above, the card handling device 100 may send playing cards to the substantially flat card output area 108 one-at-a-time and may not send another playing card to the substantially flat card output area 108 until a previously sent playing card has been removed from the substantially flat card output area 108.

Referring to FIGS. 1, 2, and 6 together, the overall flat structure of the substantially flat card output area 108 and the orientation of the card intake area 208 of the card input portion 202 (e.g., proximate the substantially flat card output area 108) may permit a majority of the card handling device 100 to the mounted beneath a table surface 210 of a table 212 to which the card handling device 100 is mounted.

Figure 7:
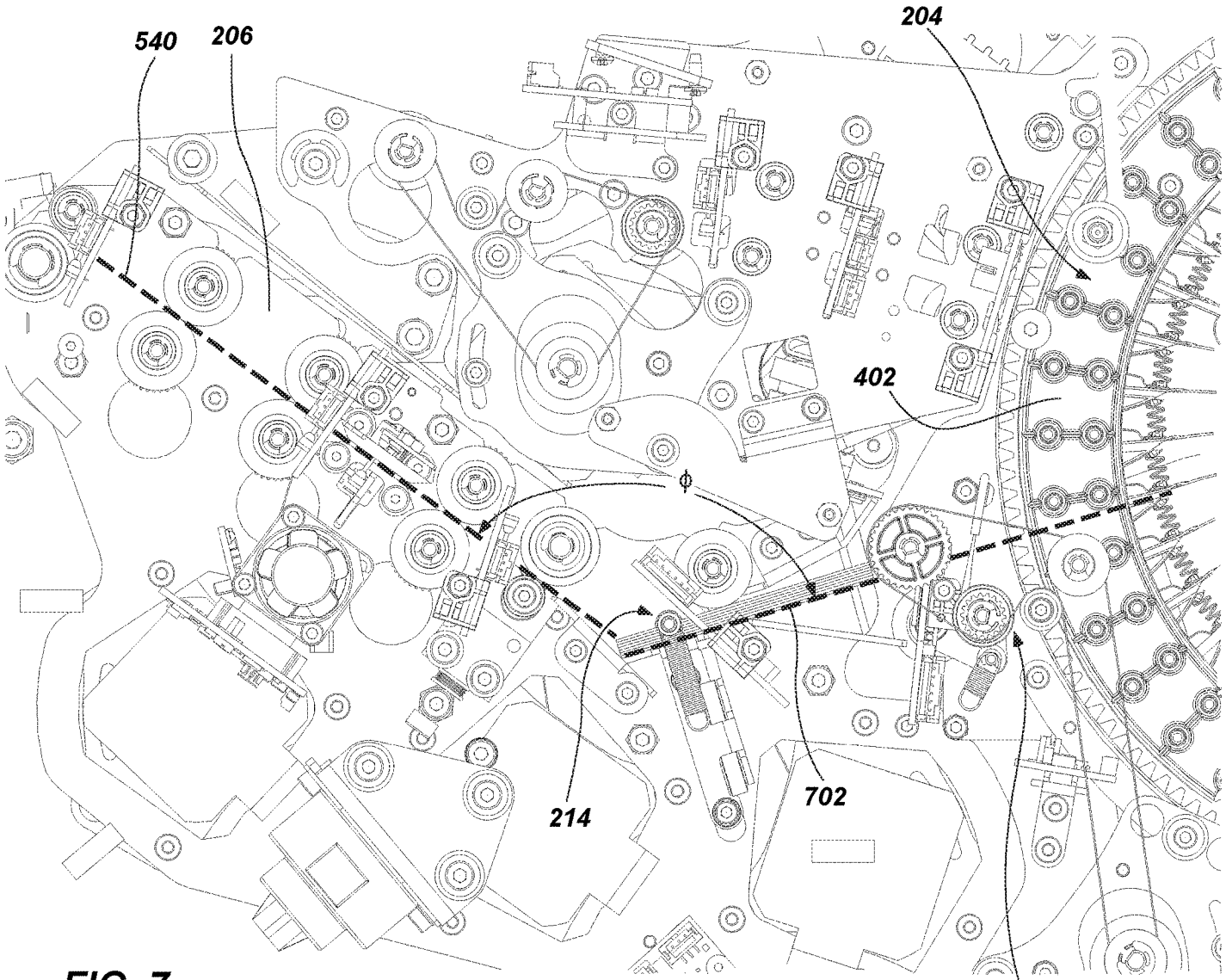
FIG. 7 shows an enlarged side view of a card pathway of a card handling device according to an embodiment of the present disclosure.

FIG. 7 is a partial side view of the card handling device 100 of FIG. 1. The card transfer system 502 of the card shuffling apparatus 204 may at least partially define a third card pathway 702 (e.g., a pathway along which playing cards move through the card transfer system 502 when leaving the multi-compartment carousel 402 of the card shuffling apparatus 204 and entering the card buffer area 214). In some embodiments, the second card pathway 540 of the card output portion 206 and the third card pathway 702 of the card transfer system 502 may have an included angle $\phi$ defined between the second card pathway 540 and the third card pathway 702. In some embodiments, the angle $\phi$ may be between within a range of 90° and 175°. In some embodiments, the angle $\phi$ may be between within a range of 125° and 165°. Furthermore, in some embodiments, the angle $\phi$ may be different when the card output portion 206 is oriented in the first orientation than when the card output portion 206 is oriented in the second orientation.

In other words, playing cards may first travel along the third card pathway 702 while moving through the card transfer system 502 of the card shuffling apparatus 204 and to the card buffer area 214. When drawn from the card buffer area 214, the cards may then be deflected into traveling (e.g., urged to travel) along the second card pathway 540 when leaving the card buffer area 214 and traveling through the card output portion 206. Put another way, playing cards may travel in a first direction when entering into the card buffer area 214 and may travel in a second different direction when leaving the card buffer area 214. In some embodiments, the first direction may define an obtuse angle with the second direction.

In some embodiments, the third card pathway 702 may extend in a direction of intended card movement that at least partially declines relative to the table surface 210 (FIG. 2) of the table 212 (FIG. 2), and the second card pathway 540 may extend in a direction that at least partially inclines relative to the table surface 210 (FIG. 2) of the table 212 (FIG. 2). In other embodiments, the third card pathway 702 may extend in the direction of intended card movement that is least substantially horizontal, and the second card pathway 540 may extend in the direction of intended card movement that at least partially inclines relative to the table surface 210 (FIG. 2) of the table 212 (FIG. 2).

Figure 8:
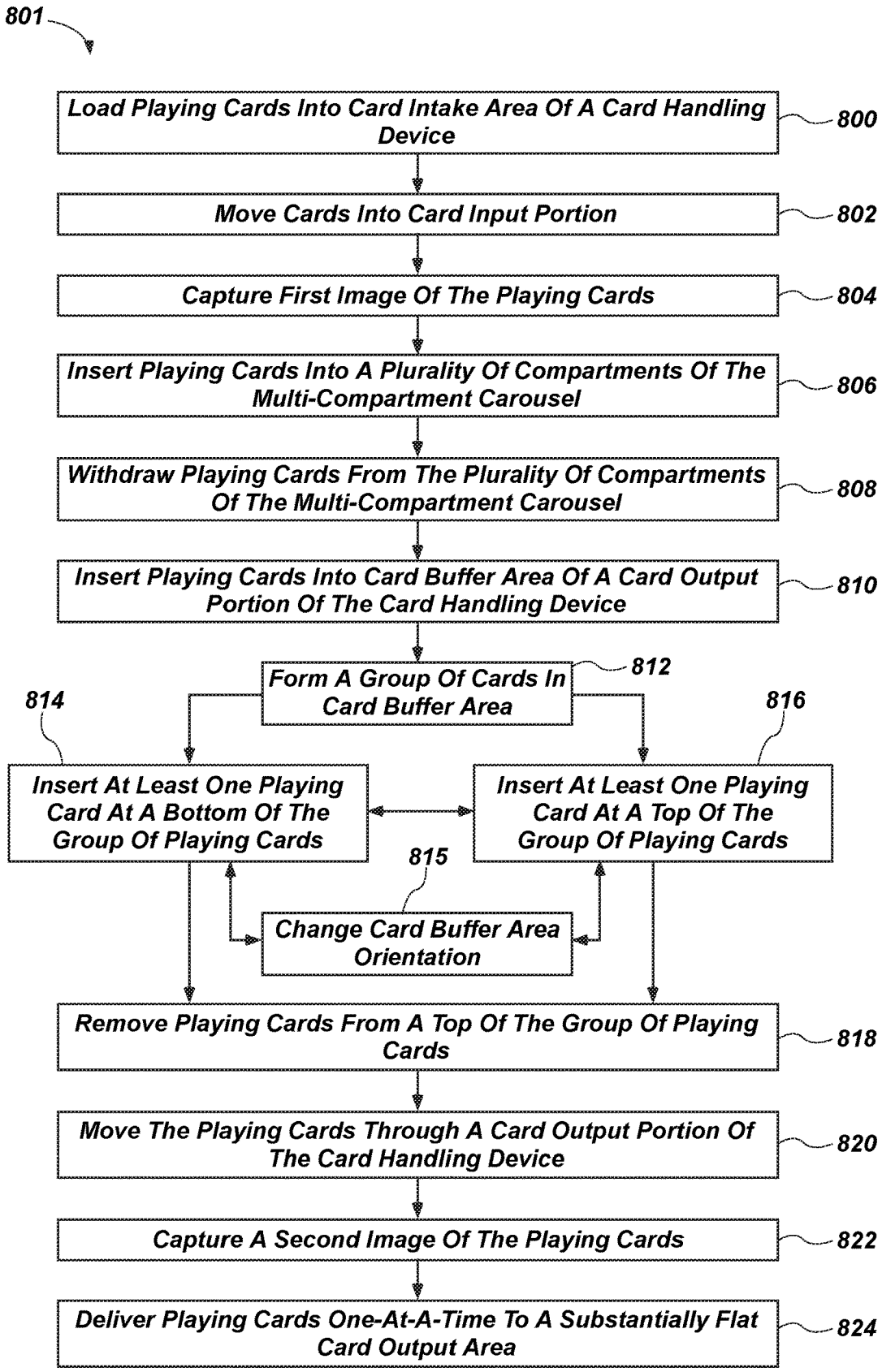
FIG. 8 is a process diagram for the shuffling of playing cards according to an embodiment of the present disclosure.

FIG. 8 shows a flow diagram of a process 801 in which the card handling device 100 may shuffle playing cards. Referring to FIGS. 2, 3, 4A, and 8 together, playing cards may be loaded into the card intake area 208 of the card input portion 202 of the card handling device 100, as represented in action 800. The playing cards may be transported by the first card feed system 306 from the card intake area 208 and through the card input portion 202 along the first card pathway 312, as represented by action 802. Along the first card pathway 312, the first card imaging system 308 may capture a first image of each playing card, as represented by action 804. The playing cards may be inserted into the plurality of compartments 406 of the multi-compartment carousel 402, as represented by action 806. The playing cards may be temporarily stored within the plurality of compartments 406 of the multi-compartment carousel 402.

Referring to FIGS. 4A, 5A-5E, and 8 together, the playing cards may be withdrawn from the plurality of compartments 406 of the multi-compartment carousel 402 by the card transfer system 502, as represented by action 808. The card transfer system 502 may insert the playing cards into the card buffer area 214 of the card output portion 206 of the card handling device 100, as represented by action 810. A group of playing cards 512 may be formed within the card buffer area 214 by inserting cards into the card buffer area 214 with the card transfer system 502, as represented by action 812.

In some embodiments, after a group of playing cards 512 has been positioned within the card buffer area 214, the card transfer system 502 may insert at least one playing card from the plurality of compartments 406 of the multi-compartment carousel 402 into the card buffer area 214 of the card output portion 206 at the bottom 542 of the group of playing cards 512, as represented by action 814. In some embodiments, after a group of playing cards 512 has been positioned within the card buffer area 214, the card transfer system 502 may insert at least one playing card from the plurality of compartments 406 of the multi-compartment carousel 402 into the card buffer area 214 of the card output portion 206 at the top 544 of the group of playing cards 512, as represented by action 816. In some embodiments, after at least one playing card has been inserted at the top 544 or bottom 542 of the group of playing cards 512, the orientation of the card output portion 206, and as a result, the orientation of the card buffer area 214 relative to the card shuffling apparatus 204 may be changed, as represented by action 815. The orientation of the card buffer area 214 may be changed (e.g., back and forth, continuously, intermittently, etc.) to enable the card transfer system 502 to insert playing cards at both of the top 544 and the bottom 542 of the group of playing cards 512 formed in the card buffer area. For example, the orientation of the card output portion 206 may be changed from the first orientation to the second orientation or from the second orientation to the first orientation.

Playing cards may be removed from the card buffer area 214 by the pick-off roller 524 from the top 544 of the group of playing card 512, as represented by action 818. The playing cards may be moved through the card output portion 206 by the second card feed system 306 from the card buffer area 214 and along the second card pathway 540, as represented by action 820. Along the second card pathway 540, the second card imaging system 508 may capture a second image of each playing card, as represented by action 822. The playing cards may be delivered to the substantially flat card output area 108, where the playing cards may be drawn from the substantially flat card output area 108 in multiple, different, at least substantially horizontal directions relative to the second card pathway 540, as represented by the action 824.

Figure 9:
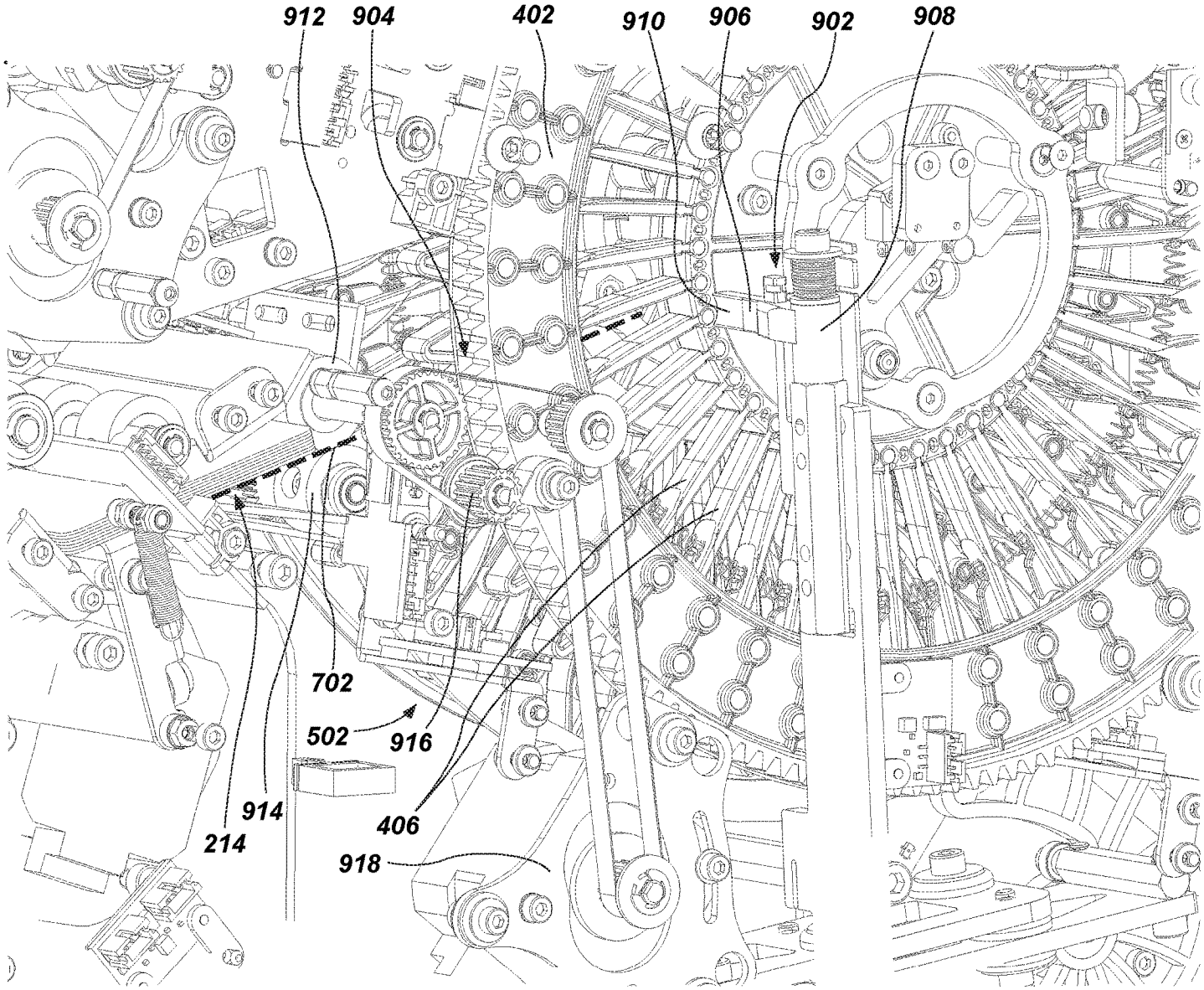
FIG. 9 shows a perspective view of a card transfer system for removing playing cards from a card shuffling apparatus of a card handling device according to an embodiment of the present disclosure.

FIG. 9 is an enlarged perspective view of the card transfer system 502. The card transfer system 502 may include an ejection assembly 902 for removing cards from the multi-compartment carousel 402 and a discharge feeder system 904 for inserting playing cards into the card buffer area 214. The ejection assembly 902 may include at least one pusher arm 906 and at least one post 908. The at least one pusher arm 906 may be pivotally coupled to the at least one post 908 and may be configured to pivot (e.g., rotate) about the at least one post 908. The at least one pusher arm 906 may extend longitudinally from the at least one post 908 in a direction at least substantially perpendicular to a direction in which the at least one post 908 extends. When the at least one pusher arm 906 pivots about the at least one post 908, a distal end 910 of the at least one pusher arm 906 (e.g., the end of at least one pusher arm not coupled to the at least one post 908) may translate proximate the plurality of compartments 406 of the multi-compartment carousel 402. In some embodiments, the distal end 910 of the at least one pusher arm 906 may at least partially translate along the third card pathway 702 of the card transfer system 502. During translation, the distal end 910 of the at least one pusher arm 906 may be configured to catch an edge of a side (e.g., lateral side) of at least one playing card located in a compartment 406 of the plurality of compartments 406 of the multi-compartment carousel 402. For example, portions of the playing cards may extend longitudinally from both sides of the plurality of compartments 406, and the distal end 910 of the at least one pusher arm 906 may catch portions of the playing cards that extend from the plurality of compartments 406 when the at least one pusher arm 906 pivots about the at least one post 908. Furthermore, the at least one pusher arm 906 may be configured to push the at least one playing card from the compartment 406 and push the at least one playing card along the third card pathway 702 of the card transfer system 502 and into the discharge feeder assembly 904 of the card transfer system 502.

In some embodiments, the card transfer system 502 may include an ejection assembly 902 on each lateral side of the multi-compartment carousel 402. For example, the card transfer system 502 may include a first ejection assembly of a first side of the multi-compartment carousel 402 and a second ejection assembly on a second side of the multi-compartment carousel 402. Furthermore, the first and second ejection assemblies may cooperate (e.g., be synchronized) to remove the at least one card from the plurality of compartments 406 of the multi-compartment carousel 402. For example, a first pusher arm of the first ejection assembly may catch a portion of the at least one playing card protruding from a first side of a compartment 406 and a second pusher arm of the second ejection assembly may catch a portion of the at least one playing card protruding from a second side of a compartment 406. Together, the first and second ejection assemblies may push the at least one playing card from the compartment 406 and along the third card pathway 702 of the card transfer system 502 and into the discharge feeder assembly 904 of the card transfer system 502.

The discharge feeder assembly 904 may include two discharge rollers 912, 914 configured to grip at least one playing card between the two discharge rollers 912, 914. For example, the two discharge rollers 912, 914 may be configured to grip playing cards that are pushed out of the plurality of compartments 406 of the multi-compartment carousel 402 by the ejection assembly 902 of the card transfer system 502. In other words, the ejection assembly 902 may push cards out of the plurality of compartments 406 of the multi-compartment carousel 402 and then may push the playing cards between the two discharge rollers 912, 914.

The two discharge rollers 912, 914 may rotate relative to one another, grip the playing cards between each other, and insert the playing cards into the card buffer area 214 of the card output portion 206. In some embodiments, one of the two discharge rollers 912, 914 may freely rotate and another of the two discharge rollers 912, 914 may be coupled to a gear and belt system 916 that is operated by a discharge motor 918. The gear and belt system 916 and discharge motor 918 may rotate the another of the two discharge rollers 912, 914 and may be controlled by the control system 105 (FIG. 1). In some embodiments, both of the two discharge rollers 912, 914 may be coupled to the gear and belt system 916 and the discharge motor 918.

In some embodiments, the card transfer system 502 may be configured to move multiple playing cards at a time (e.g., together or in sequence). For example, the card transfer system 502 may move at least two playing cards stacked on top of each other at a time. Furthermore, the card transfer system 502 may be able to move at least one playing card with the ejection assembly 902 while simultaneously moving at least another card with the discharge feeder assembly 904. In other embodiments, the card transfer system 502 may move a single playing card at a time.

Figure 10:
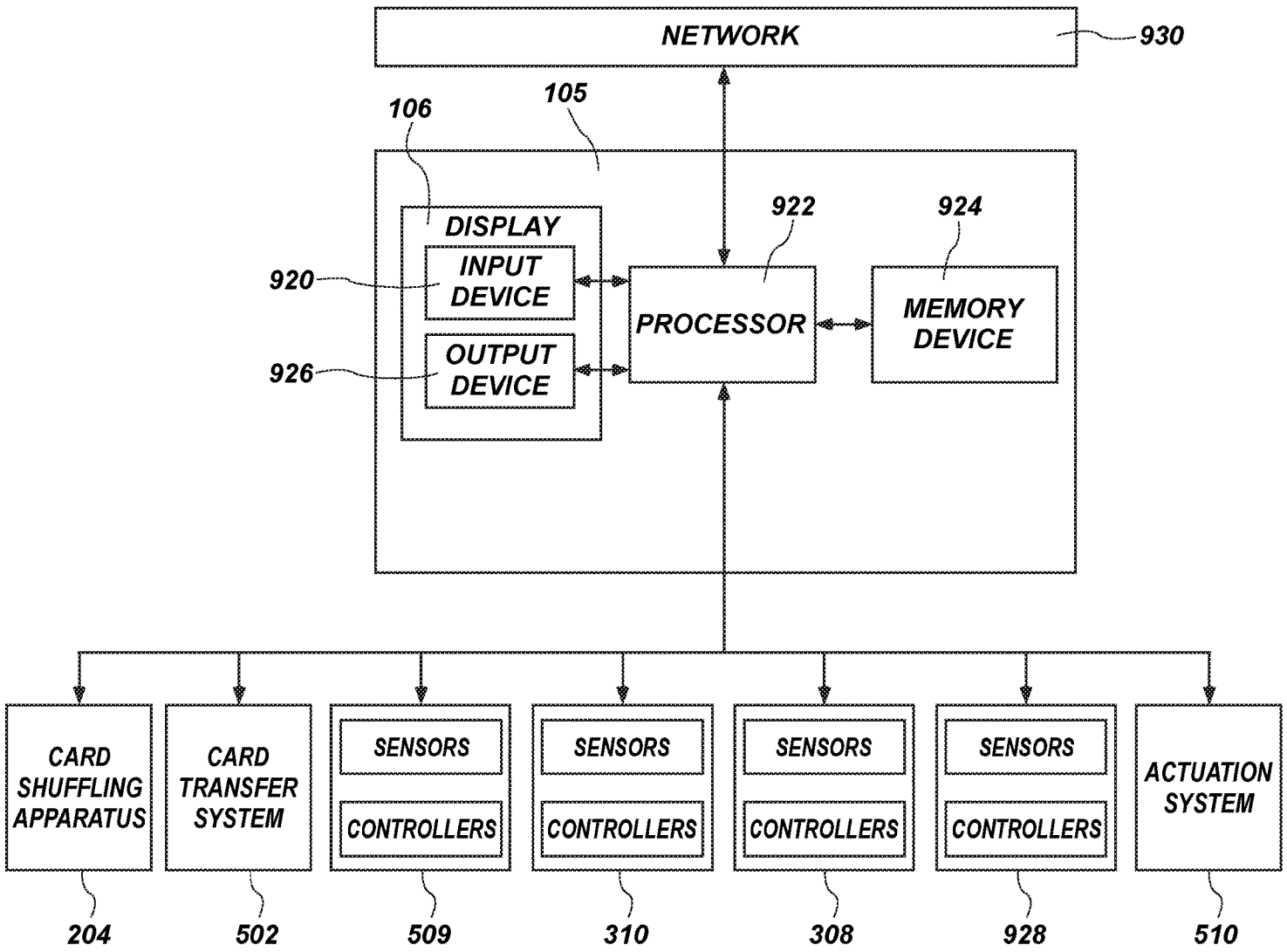
FIG. 10 is a schematic representation of a control system of a card handling device according to an embodiment of the present disclosure.

FIG. 10 is a schematic diagram of the control system 105 that may be used in embodiments of card handling devices 100 of the present disclosure, such as that shown in FIG. 1. Referring to FIGS. 1 and 10 together, the card handling device 100 may include the control system 105 for control of the various components of the card handling device 100 such as those discussed above and herein. The control system 105 may receive input signals from a user (e.g., through a display 106 and input device 920), to receive input signals from one or more of the various sensors described herein, and/or for selectively controlling one or more of the various previously described active components of the card handling device 100.

In some embodiments, the entire control system 105 may be physically located within the card handling device 100. In other words, the control system 105 may be integrated into or with the components of the card handling device 100 such as, for example, the card shuffling apparatus 204, the card input portion 202 (FIG. 2), the card output portion 206, and the flat card output area 108. In other embodiments, one or more components of the control system 105 may be physically located outside the card handling device 100. Such components may include, for example, a computer device (e.g., a desktop computer, a laptop computer, a handheld computer, personal data assistant (PDA), network server, etc.). Such external components may be configured to perform functions such as, for example, image processing, bonus system management, network communication and the like.

The control system 105 may include at least one electronic signal processor 922 (e.g., a microprocessor). The control system 105 also may include at least one memory device 924 for storing data to be read by the electronic signal processor 922 and/or for storing data sent to the at least one memory device 924 by the electronic signal processor 922. The control system 105 also may include one or more displays 106, one or more input devices 920, and one or more output devices 926. By way of example and not limitation, the one or more input devices 920 may include a keypad, a keyboard, a touchpad, a button, a switch, a lever, a touch screen, pressure sensitive pads, etc., and the one or more output devices 920 may include a graphical display device (e.g., a screen or monitor), a printer, one or more light emitting diodes (LEDs), a device for emitting an audible signal, etc. In some embodiments, the input device 920 and the output device 926 may be integrated into a single unitary structure (e.g., the display 106).

Referring to FIGS. 1, 2, 5-7, and 10 together, the control system 105 may be configured to communicate electrically with each of the previously described sensors. For example, the control system 105 may communicate electrically with the first sensor 310 of the first card imaging system 308, the second sensor 509 of the second card imaging system 508, and the sensor 606 of the substantially flat card output area 108. Furthermore, the control system 105 may communicate electrically with additional sensors 928 that may be disposed along the first, second, and third card pathways 312, 540, 702. For example, additional sensors 928 may include sensors in the card intake area 208, proximate the pairs of rollers 316, 318, 320, proximate the discharge rollers 912, 914, proximate the buffer pick-off roller 524, or proximate the additional rollers 548, 550, 552, 554, 556, etc. In some embodiments, an additional sensor 928 may be included in front of or behind each pair of rollers (e.g., pair of rollers 316) along a respective card pathway for tracking movement of playing cards throughout the card handling device 100. Furthermore, in some embodiments, an additional sensor 928 may be included in the card intake area 208 to sense a presence or absence of playing cards in the card intake area 208. As discussed previously, each of the above listed sensors may be in electrical communication with the control system 105. Furthermore, the control system 105 may be in electrical communication with each of the controllers (e.g., motors or actuators) of each of the above listed pairs of rollers, the actuation system 510, card shuffling apparatus 204, and card transfer system 502.

In some embodiments, the card handling device 100 may be incorporated into a table game management system by connecting or otherwise providing communication between the control system 105 of the card handling device 100 and a network 930. For example, a data port (not shown) on the card handling device 100 may be used to provide electrical communication to the network 930 through a conductive wire, cable, or wireless connection. The network 930 may communicate with the electronic signal processor 922 of the control system 105. In additional embodiments, the network 930 may communicate directly with one or more above-described controllers of the card handling device 100, or with both the electronic signal processor 922 of the control system 105 and the above-described controllers of the card handling device 100.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. A card handling device having a substantially flat card output area, the card handling device comprising:

an interface portion having an at least substantially flat draw surface; and a cover disposed over the interface portion, the interface portion and the cover defining an outlet between the interface portion and the cover, the interface portion and the cover defining the outlet to comprise at least one lateral opening and a front opening, the front opening intersecting a card path exiting the card handling device, the at least one lateral opening defined between the interface portion, the cover, and at least one sidewall extending between the interface portion and the cover, the at least one sidewall recessed along the card path upstream from at least a portion of the front opening, wherein the substantially flat card output area is configured to permit playing cards to be drawn from the front opening and the at least one lateral opening of the outlet of the substantially flat card output area on the draw surface of the interface portion in a plurality of different directions substantially within a plane defined by the draw surface without first being completely drawn from the outlet in a direction parallel to a center longitudinal axis of the substantially flat card output area.

2. The card handling device of claim 1, wherein a first direction of the plurality of different directions is offset at least 60° from a second direction of the plurality of different directions.

3. The card handling device of claim 1, wherein the draw surface of the interface portion of the substantially flat card output area is configured to be positioned at an angle less than 10° relative to a table surface of a table on which the substantially flat card output area is positioned.

4. The card handling device of claim 1, wherein the interface portion of the substantially flat card output area further comprises a first end and a second opposite end, and wherein the cover of the substantially flat card output area further comprises:

a base portion oriented above the second end of the interface portion; and two laterally spaced arm portions separated by a cutout and extending from the base portion toward the first end of the interface portion, wherein each of the two arm portions of the base portion is separated from the draw surface of the interface portion of the substantially flat card output area to form at least one opening.

5. The card handling device of claim 4, wherein each of the two laterally spaced arm portions is cantilevered over the draw surface of the interface portion of the substantially flat card output area by a portion of the at least one opening.

6. The card handling device of claim 1, wherein the substantially flat card output area is configured to permit playing cards to be drawn from the outlet of the of the substantially flat card output area on the draw surface of the interface portion in the plurality of different, at least substantially horizontal directions including directions that are perpendicular to each other.

7. The card handling device of claim 1, wherein the substantially flat card output area is configured to permit playing cards to be drawn from the outlet of the of the substantially flat card output area on the draw surface of the interface portion in the plurality of different directions including directions that are 135° apart.

8. The card handling device of claim 1, wherein the at least one lateral opening comprising two lateral openings being defined by the interface portion, the cover, and the at least one sidewall comprising two sidewalls positioned on opening sides of the card path.

9. The card handling device of claim 1, wherein the at least one sidewall is part of one of the interface portion or the cover.

10. A card handling device having a card output area, the card handling device comprising:

an interface portion having a draw surface configured to supply playing cards to a user of the card handing device, the draw surface configured to be positioned at an angle between 0° and 10° relative to a horizontally extending table surface of a table adjacent to which the card output area is positioned; and a shuffling portion comprising at least one card randomization feature for randomizing the playing cards, a majority of the shuffling portion configured to be positioned vertically below the table surface of the table; and a cover disposed over the interface portion, the interface portion and the cover defining an outlet between the interface portion and the cover, the cover comprising a cantilevered portion extending over the output of the card output area, wherein side openings defined by the cantilevered portion define additional card paths on lateral sides of the card output area through which the playing cards are configured to pass.

11. The card handling device of claim 10, wherein the card output area is configured to permit the playing cards to be drawn from the outlet of the card output area over the draw surface of the interface portion in a plurality of different directions substantially within a plane defined by the draw surface without first being drawn from the outlet in a direction along a card path leading to the card output area.

12. The card handling device of claim 11, wherein the card output area is configured to permit playing cards to be drawn from the outlet of the of the card output area on the draw surface of the interface portion in the plurality of different directions including directions that are between 90° and 180° apart.

13. The card handling device of claim 10, wherein the cantilevered portion comprises a cutout configured to expose a portion of a face of the playing cards in the card output area.

14. The card handling device of claim 10, wherein the draw surface is configured to be positioned at an angle between 0° and 5° relative to the horizontally extending table surface of the table.

15. The card handling device of claim 10, wherein the card output area comprises at least one sensor, the at least one sensor configured to sense when a playing card is present in the card output area.

16. A card handling device comprising:

a card output area having a draw surface; and a cover disposed over the draw surface, the draw surface and the cover defining an outlet between the draw surface and the cover, the cover comprising a cantilevered portion extending over the card output area, wherein the card output area is configured to permit playing cards to be drawn from the outlet of the output area over the draw surface in a plurality of different directions substantially within a plane defined by the draw surface without first being drawn from the outlet in a direction along a card path along which the playing cards travel to the card output area, wherein the outlet between the draw surface and the cover is defined by surrounding structure of the card handling device to enable the cards to be drawn in the direction along the card path along which the playing cards travel to the card output area and wherein the cantilevered portion of the cover and the draw surface define side openings defining additional card paths on lateral sides of the card output area through which the playing cards are configured to pass along one or more directions transverse to the card path.

17. The card handling device of claim 16, wherein the draw surface is configured to be positioned at an angle between 3° and 10° relative to a horizontally extending table surface of a table adjacent to which the card output area is positioned.

18. The card handling device of claim 16, wherein the cantilevered portion of the cover defines a front opening at a terminal end of the card path and the side opening comprising two lateral side openings on opposing sides of the front opening and the card path.

19. The card handling device of claim 16, wherein the draw surface and the cover define the outlet in more than one plane to enable the cards to be drawn in both the direction along the card path along which the playing cards travel to the card output area and one or more directions laterally transverse to the card path.

20. The card handling device of claim 16, wherein the draw surface and the cover define the outlet to enable the cards to be drawn in both the direction along the card path along which the playing cards travel to the card output area and one or more directions laterally transverse to the card path.

* * * * *